US011499792B1

(12) United States Patent
Kempf et al.

(10) Patent No.: US 11,499,792 B1
(45) Date of Patent: Nov. 15, 2022

(54) PROJECTILE LAUNCHING DEVICE WITH SELF-TIMING AND WITHOUT CAM LEAN

(71) Applicant: Archery Innovators, Tiffin, IA (US)

(72) Inventors: James J. Kempf, Coralville, IA (US); Rex E. Isenhower, Mount Pleasant, IA (US)

(73) Assignee: ARCHERY INNOVATORS, LLC, Tiffin, IA (US)

( * ) Notice: Subject to any disclaimer, the term of this patent is extended or adjusted under 35 U.S.C. 154(b) by 0 days.

(21) Appl. No.: 17/402,957

(22) Filed: Aug. 16, 2021

Related U.S. Application Data

(63) Continuation-in-part of application No. 17/235,385, filed on Apr. 20, 2021, now Pat. No. 11,371,795, which is a continuation-in-part of application No. 16/793,127, filed on Feb. 18, 2020, now Pat. No. 11,022,398.

(60) Provisional application No. 62/864,056, filed on Jun. 20, 2019.

(51) Int. Cl.
*F41B 5/12* (2006.01)
*F41B 5/10* (2006.01)

(52) U.S. Cl.
CPC ..... *F41B 5/105* (2013.01); *F41B 5/123* (2013.01)

(58) Field of Classification Search
CPC .... F41B 5/12; F41B 5/123; F41B 5/10; F41B 5/105
USPC ..... 124/25.6, 25, 900
See application file for complete search history.

(56) References Cited

U.S. PATENT DOCUMENTS

| | | | | |
|---|---|---|---|---|
| 4,457,288 | A | 7/1984 | Ricord | |
| 6,776,148 | B1 * | 8/2004 | Islas | F41B 5/105 124/25.6 |
| 6,792,931 | B1 * | 9/2004 | Schaar | F41B 5/10 124/25.6 |
| 7,637,256 | B2 * | 12/2009 | Lee | F41B 5/10 124/25.6 |
| 8,387,603 | B2 * | 3/2013 | Darlington | F41B 5/105 124/25 |
| 8,651,095 | B2 * | 2/2014 | Islas | F41B 5/123 124/900 |
| 9,234,719 | B1 * | 1/2016 | Kempf | F41B 5/12 |
| 9,243,861 | B1 * | 1/2016 | Kempf | F41B 5/12 |
| 9,297,604 | B1 * | 3/2016 | Sidebottom | F41B 5/105 |
| 9,377,267 | B1 * | 6/2016 | Kempf | F41B 5/105 |
| 9,494,379 | B2 * | 11/2016 | Yehle | F41B 5/10 |
| 9,513,080 | B1 * | 12/2016 | Kempf | F41B 5/1411 |
| 9,759,509 | B1 * | 9/2017 | Kempf | F41B 5/123 |

(Continued)

*Primary Examiner* — Alexander R Niconovich
(74) *Attorney, Agent, or Firm* — Donald J. Ersler

(57) ABSTRACT

A projectile launching device includes self-timing without cam lean. The projectile launching device preferably includes a rail, a riser, two energy storing components, (such as two limbs), two cams, a launch string, and at least two cables. The ends of the launch string are attached to the two cams. Opposing ends of first and second cables are coupled to the first and second cams. A mid-segment of the first and second cables are slidably engaged with the first and second cable pulleys, respectively. The two cams are preferably built as mirror images of each other at a centerline of the rail. The two cams include a launch string track, having identical, but mirrored, upper and lower cable tracks. A stop is formed on each cam to prevent the cam from being able to rotate in a direction opposite the direction of drawing, when the bow is at rest.

15 Claims, 31 Drawing Sheets

(56) References Cited

U.S. PATENT DOCUMENTS

| | | | | |
|---|---|---|---|---|
| 9,829,268 | B1 * | 11/2017 | Kempf | F41B 5/105 |
| 9,879,938 | B1 * | 1/2018 | Isenhower | F41B 5/123 |
| 10,048,036 | B1 * | 8/2018 | Kempf | F41B 5/105 |
| 10,184,749 | B2 * | 1/2019 | Trpkovski | F41B 5/10 |
| 10,209,026 | B2 * | 2/2019 | Yehle | F41B 5/066 |
| 10,254,073 | B2 * | 4/2019 | Yehle | F41B 5/143 |
| 10,267,592 | B2 * | 4/2019 | Bartels | F41B 5/123 |
| 10,393,470 | B1 * | 8/2019 | Popov | F41B 5/105 |
| 10,458,742 | B1 * | 10/2019 | Kempf | F41B 5/123 |
| 10,473,418 | B2 * | 11/2019 | Shaffer | F41B 5/123 |
| 10,514,226 | B2 * | 12/2019 | Shaffer | F41B 5/105 |
| 10,533,822 | B1 * | 1/2020 | Popov | F41B 5/0094 |
| 10,712,118 | B2 * | 7/2020 | Yehle | F41B 5/1469 |
| 10,767,956 | B2 * | 9/2020 | Popov | F41B 5/123 |
| 11,022,398 | B1 * | 6/2021 | Kempf | F41B 5/105 |
| 11,371,795 | B1 * | 6/2022 | Kempf | F41B 5/105 |
| 11,378,350 | B1 * | 7/2022 | Kempf | F41B 5/123 |
| 11,402,172 | B2 * | 8/2022 | Liu | F41B 5/123 |

* cited by examiner

PROJECTILE LAUNCHING DEVICE WITH SELF-TIMING AND WITHOUT CAM LEAN

CROSS-REFERENCES TO RELATED APPLICATIONS

This is a continuation-in-part application taking priority from patent application Ser. No. 17/235,385, filed on Apr. 20, 2021, which takes priority from patent application Ser. No. 16/793,127, filed on Feb. 18, 2020. Patent application Ser. No. 16/867,899, filed on May 6, 2020 and patent application Ser. Nos. 17/235,385 and 16/793,127 are hereby incorporated by reference in their entirety.

BACKGROUND OF THE INVENTION

Field of the Invention

The present invention relates generally to archery and more specifically to a shooting bow with a unique cable arrangement, which allows a portion of first and/or second cables to be slidably engaged to a first and second pulley, and the ends of each cable are anchored to the same cam. This arrangement enables the device to have self-timing. The present invention may alternately use components other than flexible limbs for storing energy prior to launching the projectile. The present invention may be used in a reverse-draw style or conventional-draw style crossbow, having the bowstring located between the axles of the cams and the string latch mechanism, or having the string located forward the cam axles, wherein the cables are retained, at least partially, in a static position relative to the longitudinal centerline of the crossbow and are always within about thirty degrees of the line drawn from a first cam axle to a second cam axle.

The subsequent additional disclosure relates to controlling the unwanted rotational movement of the archery cams when the bow is at rest.

Discussion of the Prior Art

Historically, archery bows and crossbows have been used for war, survival, sport, and recreation. A specific component of a compound style shooting bow are the cables. Typically, each cable includes a power end and a control end. The manner in which the cables interact with the cams and limbs of the bow is of particular importance. Typically, the power end of the cable is coupled to the cam on one limb, and the control end of the cable is often coupled to the opposite limb or opposite cam. A very good way to accomplish efficiency is through a binary cam system, wherein the cables are connected to opposing cams, and as one of the cams wraps the cable on the power track, the opposite cam pays out cable from the control track. While all of these methods work to some extent, all have significant issues with performance related to cam lean, and/or assembly and cost. Due to the crossing of cables and the need to keep the cables from interfering with the flight of the arrow, the cables often are off-angle, which in turn creates twisting and torque in a cam axle, thus creating cam lean.

U.S. Pat. No. 4,457,288 to Ricord discloses a cam lever compound bow, where a bow utilizes single string wrapping pulleys journaled to the ends of the bow limbs, and the ends of the string are coupled to a cam device mounted upon the bow riser. Although, this method does remove the problem of the cables being in the way, it is very inefficient, and timing issues from one limb to the other is a factor. U.S. Pat. No. 7,637,256 to Lee discloses a compound bow, which provides a shooting bow that removes the issue of cables interfering with the flight of the arrow. However, the inefficient use of tensioning devices severely limits the potential of this device. U.S. Pat. No. 8,651,095 to Islas discloses a bowstring cam arrangement for compound crossbow, which provides a method of removing the cables from the path of the string. U.S. Pat. No. 9494379 to Yehle discloses a crossbow, where Yehle relies on four cables. Issues are created by having separate cables above and below the string track on each cam. If the cables are not of exact length, or if the upper cable stretches more than the lower cable, or visa-versa, the cables must be adjusted by the user to stay in time with each other. Timing of the cables can be a time consuming and a very difficult process. U.S. Pat. No. 9,759,509 to Kempf teaches a cable configuration wherein the cables are anchored to the cams, which allows for self-timing. More recently, Hoyt introduced a cable configuration wherein the ends of the cable are anchored to the cam, and a central portion of the cable passes through a sleeve. This system is beneficial, however still lacks the smooth passage of the cables to self-time, further there is no provision for the cams to rotate more than about 180 degrees. U.S. Pat. Nos. 9,759,509 and 9,829,268 to Kempf et al teach portal cam technology, though very advantageous, does not include the benefits of the disclosed subsequent additional disclosure. The present invention deals with the manner in which the cables are coupled to the cams of the bow or crossbow.

The additional disclosure teaches a preferred optimal cabling arrangement wherein the power cables of the crossbow are no more than 15 degrees off parallel with a line drawn between a first cam axle and a second cam axle when the crossbow is un-cocked, and no more than 15 degrees off parallel with a line drawn between a first cam axle and a second cam axle when the bow is cocked. Such a cable arrangement allows for minimal parasitic loss of energy during the release cycle of the crossbow.

When cams are not slaved to each other, the cams may be rotated slightly back and forth in a rocking fashion up to 10 to 20 degrees, which is very undesirable. This unwanted counter rotation may cause issues with timing of the cams from one side to the other. This unwanted cam rotation happens in part due to the angle of the cables relative to the anchor point of the cables and the departure point of the cable at the cable track.

When the bow is at rest, the power segment of the cable that is between anchor point of the cable end and the cam-cable departure point of the cable from the cable track is under the least amount of tension. It is possible to manually rotate one or the other of the cams, which in turn causes the opposite cam to rotate in the same direction as the manually rotated cam deceases the manually rotated cam paying out its cable and the opposite cam winding its cable. This is possible due in part to the cable power segment traveling in an arc relative to the axis of the cam as the cam rotates, wherein the cable anchor is the base, and the departure point of the cable from the cable track is getting closer to the cable anchor, allowing the cam to rotate.

For the sake of clarity, we will provide the following example. A bow has two cams, one string, and two cables. The bow string is anchored to the first cam and to the second cam. The first cable does not cross the center line of the bow, and the second cable does not cross the center line of the bow.

When at rest and the cams are perfectly timed, we will call the radial position of the power segment of the cables at zero degrees, and we will call the radial position of the cable track cam-cable departure point zero degrees. As the bowstring is drawn, the cams rotate a first, but opposite-to-each-other direction, unwinding the bowstring from the bowstring track of the cams, simultaneously the cams wind cable onto the cable tracks of the cams.

In this example, the cams rotate 315 degrees. When the bow is shot, the cams rotate the opposite direction and back to the at-rest position. The cams wind the bowstring onto the string track of the cams, and the cams unwind the cable from the cable tracks of the cams. Ideally, the cams will return the power segment of the cable to zero degrees to enable the bow to be drawn again and ready to shoot. However, as is often the case, the cams do not return to zero, they may be off a few degrees one way or the other. In fact, manual rotation of the cams is possible, making the bow out-of-time.

Additionally, if the bowstring were to break, the cams would violently counter-rotate, causing the limbs to travel outwardly possibly causing injury or damage to the limbs. This is due to three somewhat static dispositions of the limbs prior to the projectile launching device (PLD) being cocked. The first position having the limbs attached to the frame having no strings or cables attached to cams, has the limb tips at their greatest axle to axle measurement. The second position being the limbs attached to the frame and cables coupled to the cams, which brings the limb tips closer to the center line of the PLD. The third position being the limbs attached to the frame, cables coupled to the cams, and the bowstring coupled to the cams, which brings the limb tips even closer to the center line of the PLD.

The subsequent additional disclosure provides a means to prevent the unwanted counter rotation of the bow cams when the bow is at rest, or at the very end of the shot cycle.

Accordingly, there is a clearly felt need in the art to provide a shooting bow, which allows a mid-portion of first and second cables to be slidably engaged on a first and second pulley, and the ends of the cables are coupled to the same cam, respectively, wherein the cam is allowed to rotate at least 200 degrees, up to at least 360 degrees. Historically with all prior art, cams that rotate more than 200 degrees up to about 300 degrees do not require the use of a wider cable track, as the cables are not required to stack upon themselves. The cables do not cross the centerline of the shooting bow. Additionally, the cams are allowed to rotate 360 degrees due to a wider upper and lower cable track, or alternately a divided helical cable track, which allows the cable to wrap adjacent to itself.

SUMMARY OF THE INVENTION

The present invention provides a self-timing cam and cable configuration for a projectile launching device. The present invention includes a pair of cables, wherein both ends of the same cable anchors to the same cam(s), and also reduces or eliminates cam lean. The projectile launching device with self-timing and without cam lean (projectile launch device) may be applied to either a crossbow or vertical bow. The projectile launch device preferably includes a first cam, a second cam, a launch string and two cables, collectively known as a harness system. This configuration allows opposing ends of a first cable to be anchored to a first cam, and opposing end of a second cable to be anchored to a second cam. Preferably, the first and second cables do not cross a centerline of the shooting bow. In a second preferred embodiment, the projectile launching device preferably includes a string latch housing, a bow riser, a rail, a first energy storing device (such as a first limb), a second energy storing device (such as a second limb), a first cam, a second cam, at least one bowstring, and two cables.

The term "limb" may refer to what are known as solid limbs, split-limbs, tube-limbs, or any other flexible energy storing component. The bow riser is enjoined with the rail. One end of the first limb extends from a first end of the bow riser and one end of the second limb extends from a second end of the bow riser. The first cam is pivotally retained on the first limb and the second cam is pivotally retained on the second limb. A first end of the launch string is retained by the first cam and a second end of the launch string is retained by the second cam. On an alternative embodiment, a first set of first and second cable posts are located on a first side of a centerline of the rail and a second set of first and second cable posts are located on a second side of the centerline of the rail. These cable posts may be used to anchor a secondary set of cables which support the cable pulleys. The first cam includes a first cam launch string track, an upper first cam cable track, located above the launch string track, and a lower first cam cable track, located below the launch string track. The second cam includes a second cam launch string track, an upper second cam cable track, located above the launch string track, and a lower second cam cable track, located below the launch string track. The first set of first and second cable posts are located above the plane of the launch string, and the second set of first and second cable posts are located below the plane of the launch string.

A first end of the first cable is coupled to the first cam first cable post; a segment of the first cable before a middle of the first cable partially engages the first cable pulley; the middle of the first cable partially wraps the first cable track; a segment of the first cable after the middle of the first cable partially engages the first cam second cable track; and a second end of the first cable is coupled to the first cable second cable post. A first end of the second cable is coupled to the second cam first cable post; a segment of the second cable before a middle of the second cable partially engages the second cam first cable track; the middle of the second cable partially wraps the second cable pulley; a segment of the second cable after the middle of the second cable partially engages the second cam second cable track; and a second end of the second cable is coupled to the second cable second cable post.

When the launch string is drawn from a rest position to a ready to fire position, the first cam rotates in a first direction and the second cam rotates in a second direction. As the first and second cams rotate, the launch string is unwound from the first and second launch string tracks. Simultaneously, the first and second cables wind into the first and second cable tracks of the first and second cams.

A unique feature of the present invention is that both ends of the first and second cables are firmly fixed to the same cam, and the middle portions "float" or slide relative to the first and second cable pulleys. The first and second cables are of one piece, and as the cable stretches, it self-centers itself about the cable pulleys. The term "pulley" is used as a general term for a component or feature engaging the cables to allow for the smooth transition of a segment of the cables from above the bowstring to below the bowstring, from a first side of the cams to a second side of the cams, wherein the component or feature (the cable retention transition) is coupled with the frame, structure, support, barrel, or riser, providing a slide-able retention position for the segment of the cables. The cable retention transition preferably has a curved shape, which the cable makes contact with, but other shapes may also be used.

Another unique feature of the present invention is the ability of the cam to rotate a full 360 degrees, such that as the cams are rotating, the upper and lower cable portions wrap the cable cams.

In a preferred embodiment, the launch string may be releasably retained in the ready-to-fire position by mechanisms known as a string latch assembly or a string release.

In a first preferred alternative embodiment, the launch string may be held in the ready-to-fire position and released by the users' fingers.

In a second preferred alternative embodiment, a rail-less crossbow design may be used.

In a third preferred alternative embodiment, the same harness system configuration may be used on projectile launching devices utilizing energy storing components other than flexible limbs. These other types of energy storing components include spring(s), hydraulics, or pressurized cylinder(s).

In the current disclosure, a conventional-draw crossbow having conventional cams or a reverse draw style crossbow having non-inverted cams having the bowstring unwind from the rear of the cams, and the cables are engaged with the cams forward the cam axles. There is only one cable per cam, each cable having a first end and a second end, a first end adjacent segment and a second end adjacent segment, a first span, a mid-segment, and a second span. Both ends of the first cable are anchored to the first cam, and both ends of the second cable are anchored to the second cam. The mid segment of the first cable engages a first cable pulley, and the mid segment of the second cable engages a second cable pulley. The first end adjacent segment engages a first cable track on a first side of the first cam and a second end adjacent segment engages at the second cable track on a second side of the cam.

Alternately, the cable ends may anchor adjacent the longitudinal center line of the projectile launching device, and a mid-section of the cable passes through the cam. A first end of the cable is above the bowstring, and the second end of the cable is below the bowstring. Bowstring support pulleys may be between the cable anchors, in front of the cable anchors, or behind the cable anchors. It is preferred that rotating pulleys be used intros configuration, however any smooth rounded surface will suffice.

As a crossbow is being cocked, the bow limbs are moved by the cams, strings, and cables. The cam axles move in an arc, the arc is mirrored from side to side. The cables input great forces on the cams, and depending on the departure angle of the cables relative to the cam axles, unnecessary parasitic loss of energy can be caused when the crossbow is fired and the bow limbs release stored energy. Further, the static load placed on the limbs can be negatively impacted on the limbs where the cam axles are coupled with the limbs.

For clarity, the word coupled is being defined as a way to connect an object, such as a bowstring or cable, with another object, be it directly or indirectly, such as directly to a post or pulley, or indirectly as in from the end of a string or cable, to an intermediate object, and then to a limb or axle.

Though the term "pulley" has been used throughout the application, "pulley" references the component used to slidably retain and transition the cables from a first side of the bowstring track to a second side of the bowstring track, any component fulfilling the same function may be utilized and may or may not be known as a pulley in the traditional sense, and may or may not function as a rotatable pulley, as rotation of the component is not a prerequisite to retention and transition of said the cables.

The term "rail" is used as a general term describing an elongated component that directly or indirectly supports the front of an arrow. "Rail-less" crossbows still have an elongated component that is coupled with a riser or other structure, wherein the elongated component directly or indirectly supports the front of an arrow.

The term "slidably" as used in the application as to reference how a segment of the cables engage the cable "pulleys", in that the mid-segment of the cable is retained by, and not fixed to, the "pulley". The first and second ends of the cables are anchored in a fixed position relative to each other, preventing the mid-segment of the cables from actually moving back and forth, or sliding.

Accordingly, there is a clearly felt need in the art for a projectile launching device with no cam lean, having a first cam, a second cam, a launch string and at least two cables, collectively known as a harness system, where both ends of the same cable are rigidly attached to the same cam, and the mid-portion of each cable at least partially wraps a cable pulley.

Further, there is a clearly felt need in the art to provide a shooting bow, which allows a mid-portion of first and second cables to be slidably engaged on a first and second pulley, and the ends of the cables are coupled to the same cam, respectively, wherein the cam is allowed to rotate at least 200 degrees up to about 300 degrees, and up to at least 360 degrees. Historically with all prior art, cams that rotate more than 200 degrees up to about 300 degrees do not require the use of a wider cable track, as the cables are not required to stack upon themselves. The cables do not cross the centerline of the shooting bow.

Additionally, there is a need in the art to provide a projectile launching device which allows the bowstring to begin the draw cycle not in contact with a supporting pulley, come in contact with a support pulley, and stay in contact with the support pulley through the remainder of the draw cycle, including while in the cocked position. There is also need in the art for a projectile launching device which allows the bowstring to begin the draw cycle in contact with supporting pulleys, and stay in contact with the supporting pulleys through the entire draw cycle, including while the bowstring is in the cocked position. It is most advantageous to have the bowstring in contact with support pulleys when the bowstring is at rest, especially when the center-to-center distance between the axles is less than about six inches, or less than about 5 inches, or less than about four inches, or less than about three inches. The shorter the distance between the center of the support pulleys is, the less the bowstring is allowed to oscillate, which translates to smoother post-shot vibration.

Finally, the cams may be allowed to rotate up to 360 degrees due to a wider upper and lower cable track, or alternately a divided helical cable track, which allows the cable to wrap adjacent to itself.

These and additional objects, advantages, features and benefits of the present invention will become apparent from the following specification.

The additional disclosure teaches a preferred optimal cabling arrangement wherein the power cables of the crossbow are parallel with the bowstring when the crossbow is in the un-cocked position and no more than 30 degrees off parallel when the crossbow is cocked, or no more than 15 degrees off parallel with a line drawn between a first cam axle and a second cam axle when the crossbow is un-cocked, and no more than 15 degrees off parallel with a line drawn between a first cam axle and a second cam axle when the bow is cocked, or an alternative of an angle no more than 30 degrees total movement of the cable during the draw cycle and release cycle. Such a cable arrangement allows for minimal parasitic loss of energy during the release cycle of the crossbow.

The subsequent additional invention teaches improved to self-timing and the prevention of the unwanted over-rotation and oscillation by way of strategically placed "stops" also known as a boss, on the cams, or possibly the limbs or energy storing devices. The stop creates a cam-cable departure point at the location where the cable loses contact with the stop when the bow is at rest. For the sake of clarity we will provide the following non-limiting example. A bow has two cams, one string, and two cables. The bow string is anchored to the first cam and to the second cam. The first cable does not cross the center line of the bow, and the second cable does not cross the center line of the bow.

We will draw an imaginary line (LAA) between the axis of the cam supporting axles and the center of the cable end anchors.

When at rest, we will call a line (LCPS) on the radial position of the power segment (PS) of the cables at zero degrees, and we will call a line (LACD) from the radial position of the cam-cable departure point to the axis of the cam supporting axle zero degrees. As the bowstring is drawn, the cams rotate a first but opposite-to-each-other direction, unwinding the bowstring from the bowstring track of the cams, simultaneously the cams wind cable onto the cable tracks of the cams.

In this example, the cams rotate 315 degrees. When the bow is shot, the cams rotate in the opposite direction and back to the at-rest position. The cams wind the bowstring onto the string track of the cams, and the cams unwind the cable from the cable tracks of the cams. The power segment (PS) of the cables will return to zero degrees.

The preferred embodiment discloses a boss or stop adjacent the cable cam cable track creating a cam-cable departure point (CCDP), which prevents the cam from being able to be manually rotated the opposite direction of drawing the bow when the bow is at rest. The cables interact with the boss(es). The boss is located adjacent line LAA. The CCDP is located as to force the alignment of the cable power segments with line LAA.

Further explanation of this is that when a cam rotates on the axis of the cam supporting axle, an arc is created by the movement of the cam-cable departure point. The shortest distance between the axis of the cam supporting axle and the cable anchor point is where the arc and the line intersect, and this is also the only position of the elements of the cams, strings, and cables that allow for no unwanted counter rotation of the cams.

In the preferred embodiment, this boss does not project from the surface of the cams in such a manner as to touch the limbs or energy storing devices in any way. The height of the boss may be sufficient as to stop the unwanted cam rotation, but not so tall as to adversely affect the function of the cams.

In this embodiment, the cable will be in contact with at least a portion of the surface of the boss when the bow is at rest, this is called the CCDP. As the bow is drawn, the cable may disengage from the boss as the cable wraps the cable track.

An alternate embodiment may have a boss that projects from the surface of the cam to interact with the limbs or energy storing devices in such a manner as to act as a stop, and stop the rotation of the cams at a desired position.

In another embodiment, the cam may be designed to function without a boss to restrict the counter rotation of the cam. This may be accomplished by integrating the CDP with the cable track.

Another preferred embodiment requires no stop or boss. The location of the portal and the CCDP of the portal is such that no counter-rotation of the cams is allowed. The shortest distance between two points is a straight line. To that end, the placement of the CCDP of the portal is between the axis of the cam supporting axles and the cable anchor points or retainment points of the pulleys. This specific placement of the CCDP of the portal sets the cams in a specific radially position, in that any rotation of the cams, either direction, will always bring the cams back to this same specific radial position.

Though the straight alignment of the axis of the cam supporting axle, the CCDP allows for the shortest length cables possible on a projectile launching device (PLD). This placement also allows for very little movement of the limbs or energy storing devices should the bowstring break. The length of the bowstring is only required to be sufficient as to place tension on the harness when the PLD is at rest. The static position of the limbs and cams when the cables are coupled to the cams is only fractionally greater than their position when the bowstring is coupled to the cams. In fact, this static position of the limbs and cams could theoretically be the same whether the bowstring is coupled or not.

In one embodiment, the string could be of sufficient length as to functionally couple to the cams without altering the static position of the limbs and cables. In another embodiment, the string would be of a shorter length than the sufficient length to functionally couple to the cams without altering the static position of the limbs and cams.

Placement of the cable anchors or pulleys may be located at any functional position of the PLD, though the preferred placement would be located between the static position of the bowstring when the PLD is at rest and a line (PPC) drawn between the most proximal portion of the cams.

The present invention utilizes features that retain the cables as part of the PLD. These features are cam cable-retainment features, and a non-cam cable-retainment features. One embodiment may utilize a cam cable-retainment features of a portal and a CDP and non-cam cable-retainment features such as cable anchor posts. Another embodiment may utilize a cam cable-retainment features of a cable anchor and a CDP and non-cam cable-retainment features such as a pulley or hub.

DETAILED DESCRIPTION OF THE PREFERRED EMBODIMENTS

Figure 1A:
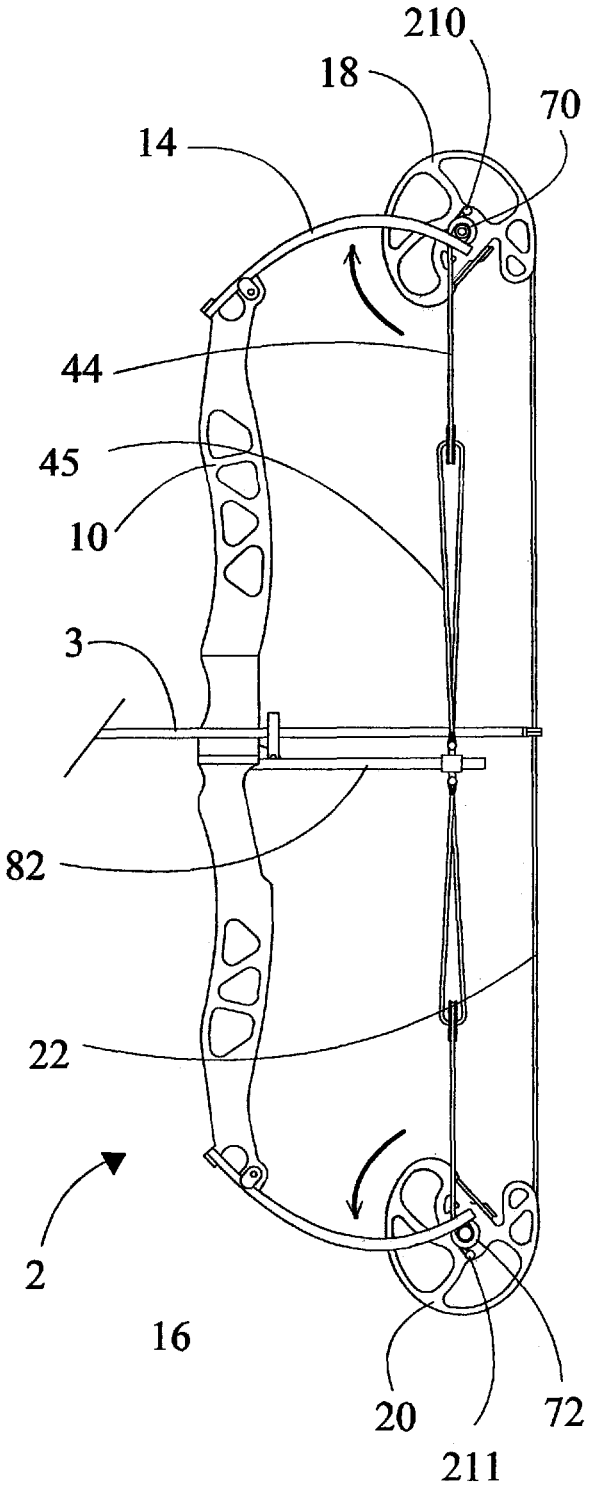
FIG. 1A is a partial rear view of a vertical bow of the present invention, having a first and second cam, a first and second cable, and a string, wherein opposing ends of the same cable are anchored to the same cam, and a mid-portion of the cables partially wrap a cable pulley of the present invention.
Figure 1B:
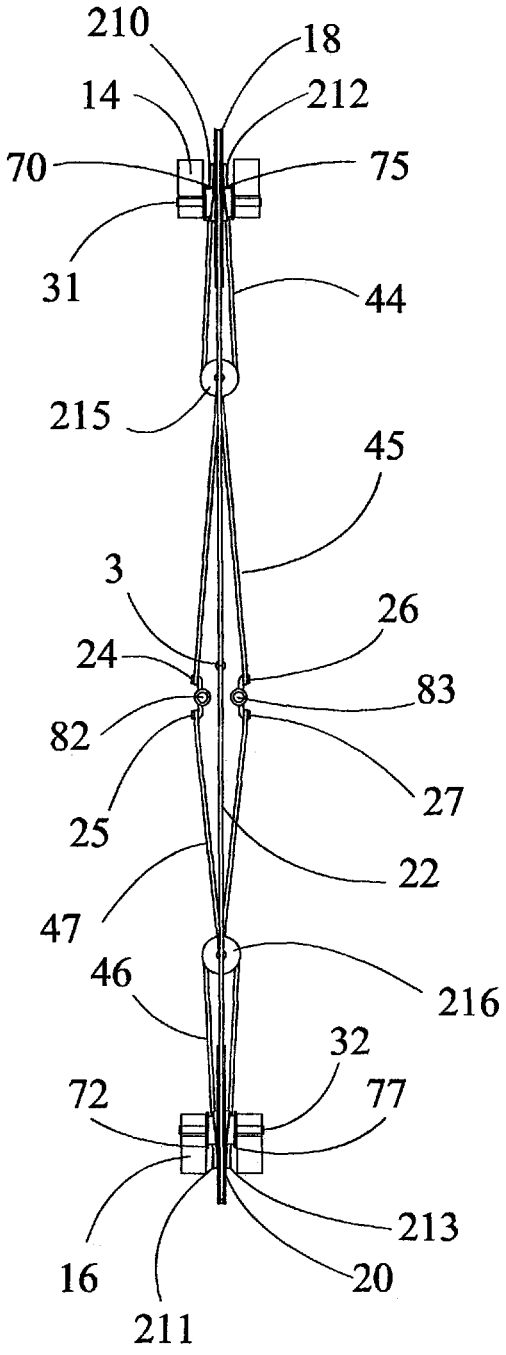
FIG. 1B is a partial rear view of a vertical bow of the present invention, having a first and second cam, a cable, and a string, wherein opposing ends of the same cable are anchored to the same cam, and a mid-portion of the cables partially wrap a cable pulley of the present invention.

With reference now to the drawings, FIGS. 1, 1A and 1B show views of a vertical bow-type projectile launching device 2. The projectile launching device 2 preferably includes a bow riser 10, a first limb 14, a second limb 16, a first cam 18, a second cam 20 and a launch string 22. One end of the first limb 14 is attached to a first end of the bow riser 10 and one end of the second limb 16 is attached to a second end of the bow riser 10. The first cam 18 is pivotally retained on an opposing end of the first limb 14 with a first axle 31 and the second cam 20 is pivotally retained on an opposing end of the second limb 16 with a second axle 32.

With more specific reference to FIG. 1A, the disclosed embodiment illustrates a vertical bow 2 having a first cable 44 and a second cable 46, wherein a first end of the first cable 44 is anchored to a first cable first post 210, and a second end of the first cable 44 is anchored to a first cable second cable post 212. A first end of the second cable 46 is anchored to a second cable first cable post 211 and a second end of the second cable 46 is anchored to a second cable second post 213. A first cable spanner bar 82 is coupled to the riser 10 on a first side of the launch string 22, and a second cable spanner bar 83 is coupled to the riser 10 on a second side of the launch string 22. The cable spanner bars 82 and 83 displace the first and second pulley mounting cables 45 and 47 a distance away from the launch string 22 to allow clearance for an arrow 33.

More specifically referring to FIG. 1B, the disclosed embodiment illustrates a vertical bow 2. The first spanner bar 82 is coupled to the riser 10 on the first side of the launch string 22, and the second spanner bar 83 is coupled to the riser 10 on the second side of the launch string 22. A first end of a first cable 44 is coupled to a first cam 18 first cable anchor 210, a mid-segment of said first cable partially wraps a first cable pulley 215, and a second end of said first cable anchors to a first cam 18 second cable post 212. A first end of a second cable 46 is coupled to a second cam 20 first cable anchor 211, a mid-segment of said second cable 46 partially wraps a second cable pulley 216, and a second end of said second cable 46 anchors to a second cam 18 second cable post 213. The first cable pulley 215 is coupled to a first pulley mounting cable 45 and first and second first pulley mounting cable post 24 and 26. The second cable pulley 216 is coupled to a second pulley or transition mounting cable 47 and first and second second-pulley mounting cable post 25 and 27.

Figure 2A:
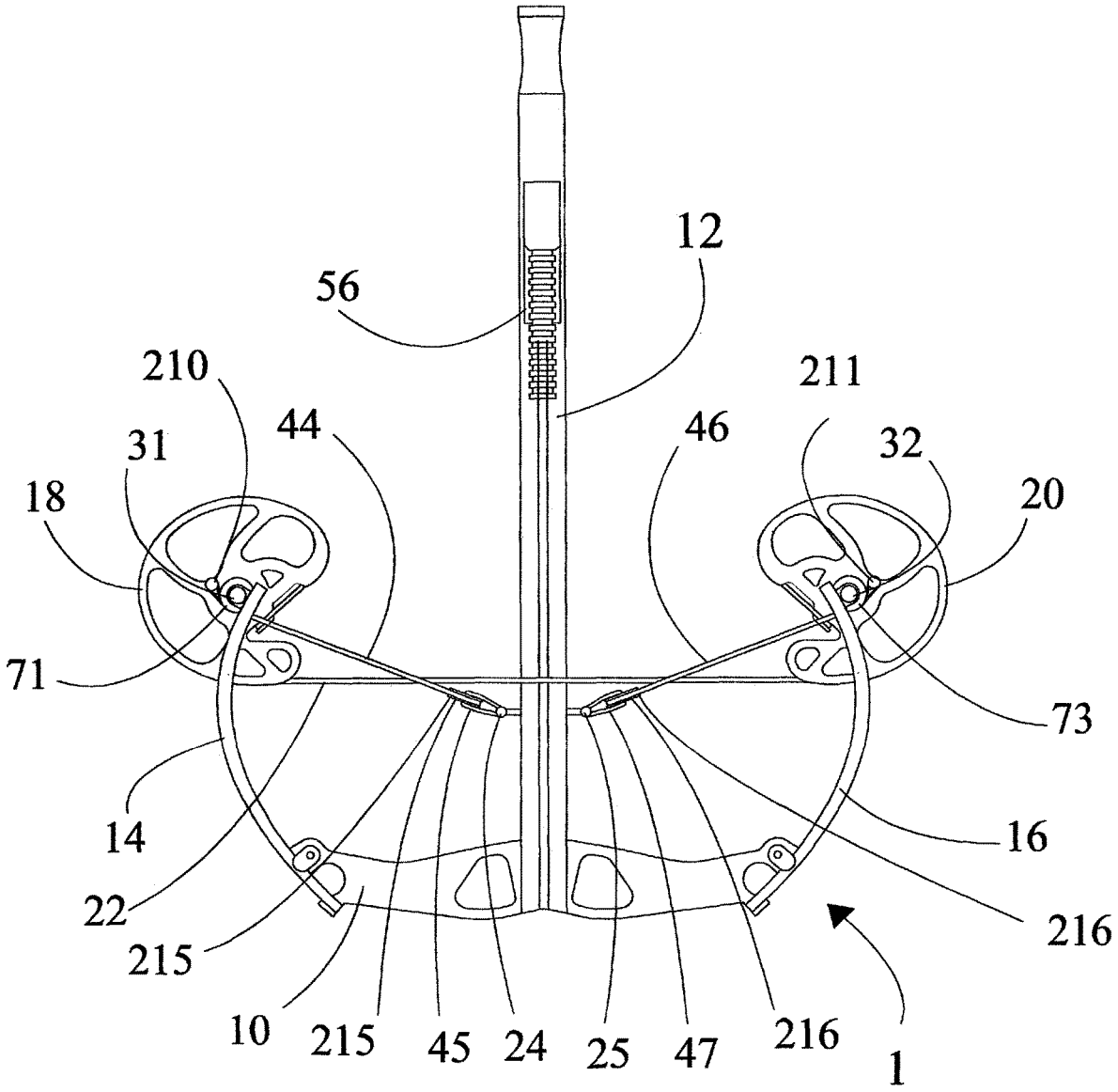
FIG. 2A is a top view of a conventional limb crossbow with inverted cams of the present invention in an at-rest position, having first and second cams; first and second cables; and a string, wherein opposing ends of the same cable are anchored to the same cam, and a mid-portion of the cables partially wrap a cable pulley of the present invention.
Figure 2B:
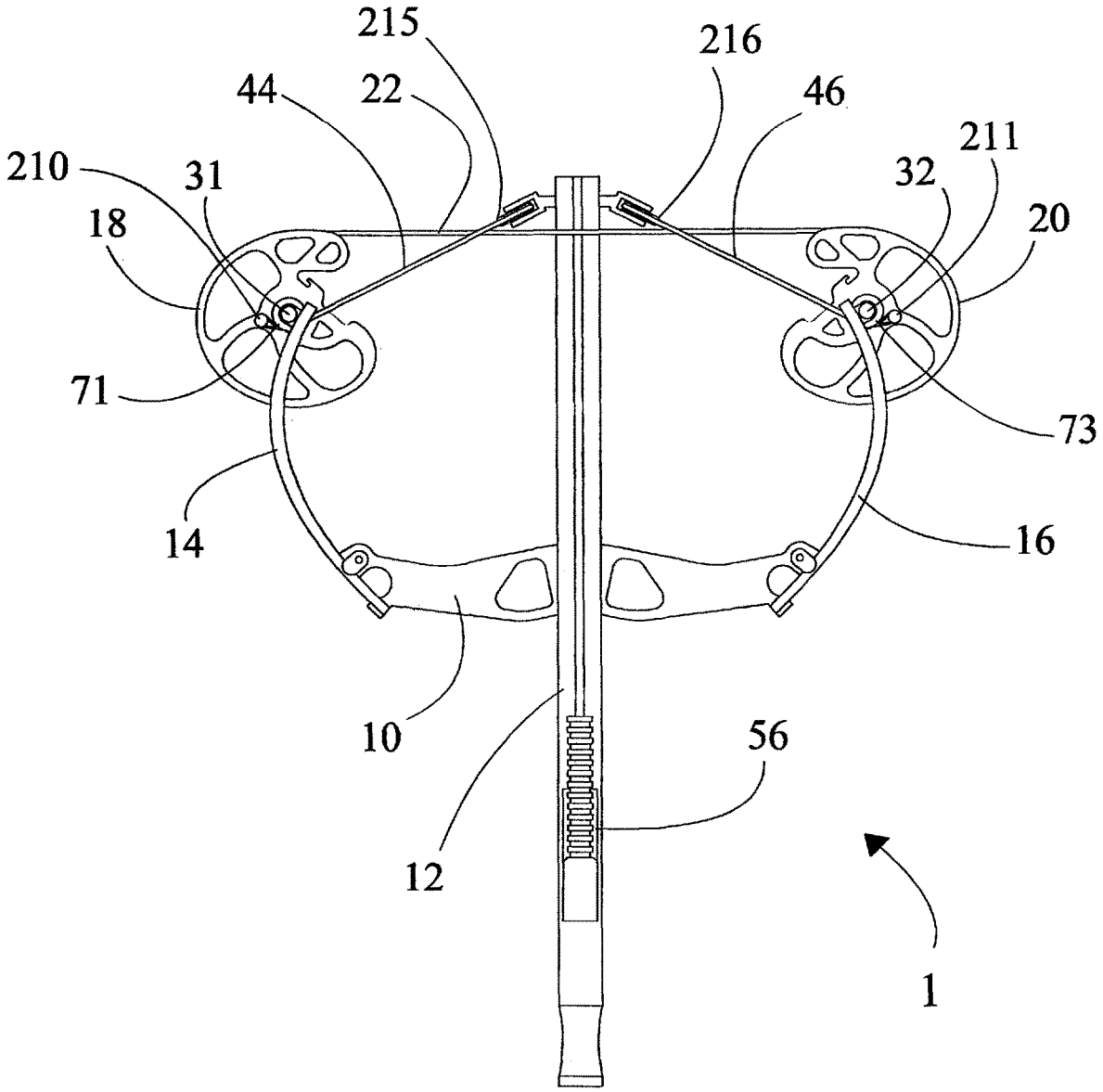
FIG. 2B is a top view of a reverse draw crossbow of the present invention in an at-rest position, having first and second cams; first and second cables; and a string, wherein opposing ends of the same cable are anchored to the same cam, and a mid-portion of the cables partially wrap a cable pulley—of the present invention.

FIGS. 2A and 2B illustrate a crossbow 1 of the current invention. The bow riser 10 may be joined with the rail 12 in any method known to join two pieces, as well as the rail 12 and the riser 10 being formed together as a single unit. The projectile launching device 1 preferably includes the riser 10, the rail 12, a first limb 14, a second limb 16, a first cam 18, a second cam 20 and a launch string 22.

A first end of the first limb 14 is coupled to a first end of the bow riser 10 and a first end of the second limb 16 is coupled to a second end of the bow riser 10. The first cam 18 is pivotally retained on an opposing end of the first limb 14 and the second cam 20 is pivotally retained on an opposing end of the second limb 16. The crossbow 1 includes a first cable 44 and a second cable 46. With reference to FIGS. 2A and 2B, the first end of the first cable 44 is anchored to the first cable first post 210, and the second end of the first cable 44 is anchored to the first cam second cable post 212. The first end of the second cable 46 is anchored to the second cable first cable post 211, and the second end of the second cable 46 is anchored to the second cable second post 213.

The first end of the first pulley mounting cable 45 is coupled to a first cable pulley or the first cable retention transition 215 and a first pulley mounting cable first and second post 24 and 26 (26 not shown). The first end of the second pulley mounting cable 47 is coupled to a second cable pulley or the second cable retention transition 216 and a second pulley mounting cable first and second post 25 and 27 (27 not shown).

Figure 2C:
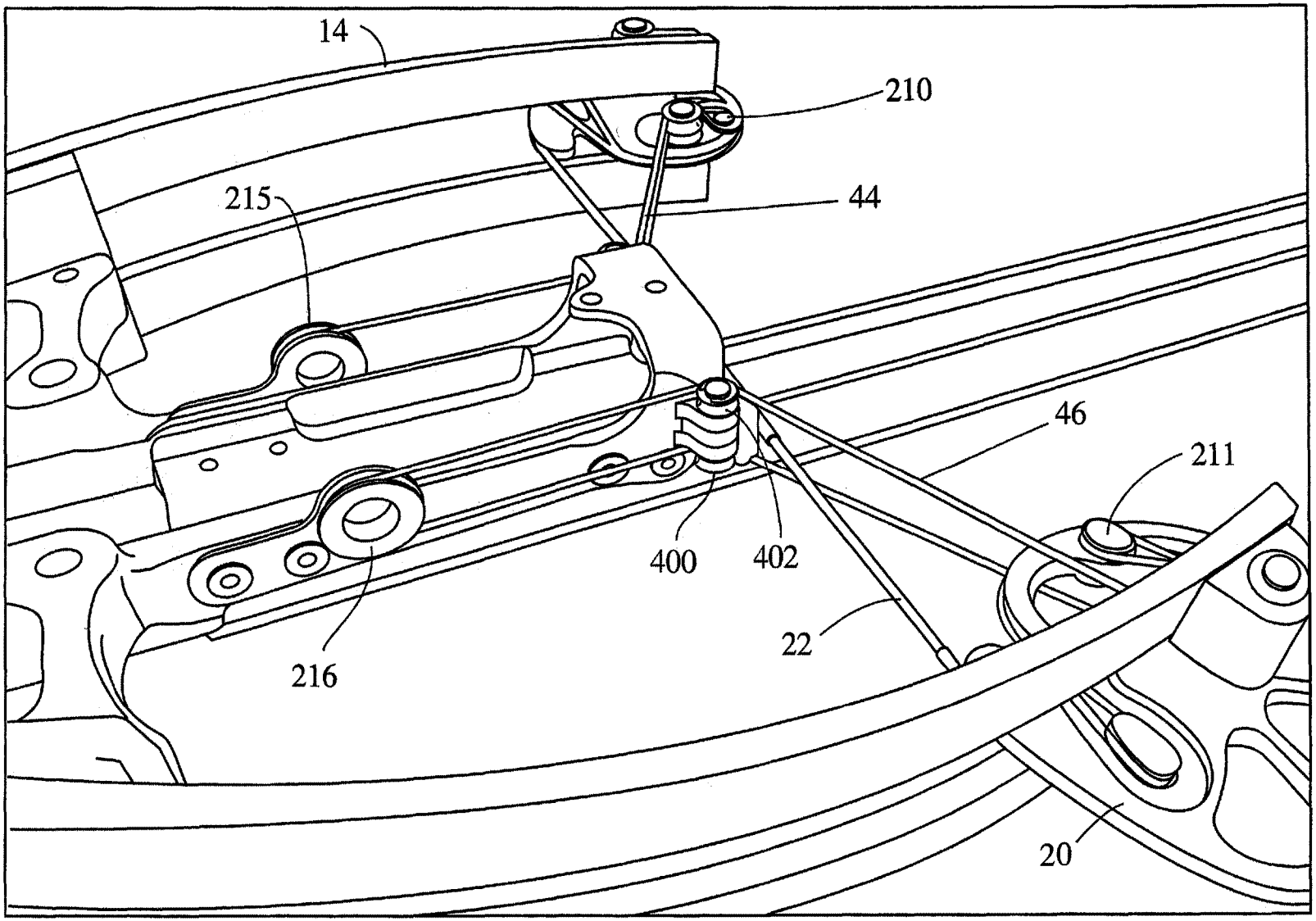
FIG. 2C is a perspective view of a crossbow with the string at rest where each end of a first cable is anchored to a first cam, each end of a second cable is anchored to a second cam, and first and second directional transition components are located between the cams and the cable pulley of the present invention.
Figure 2D:
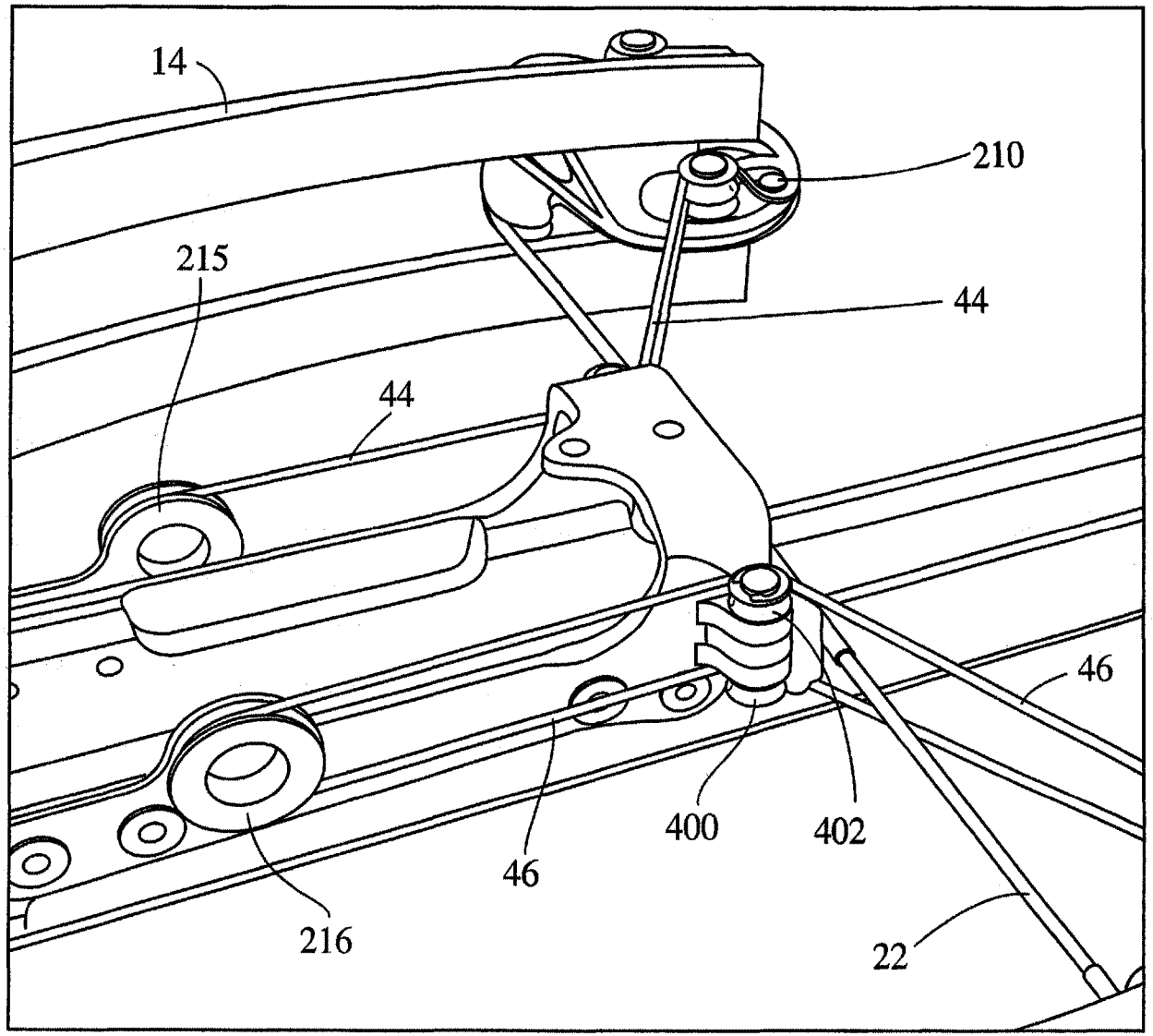
FIG. 2D is a first close up view of FIG. 2C of the present invention.
Figure 2E:
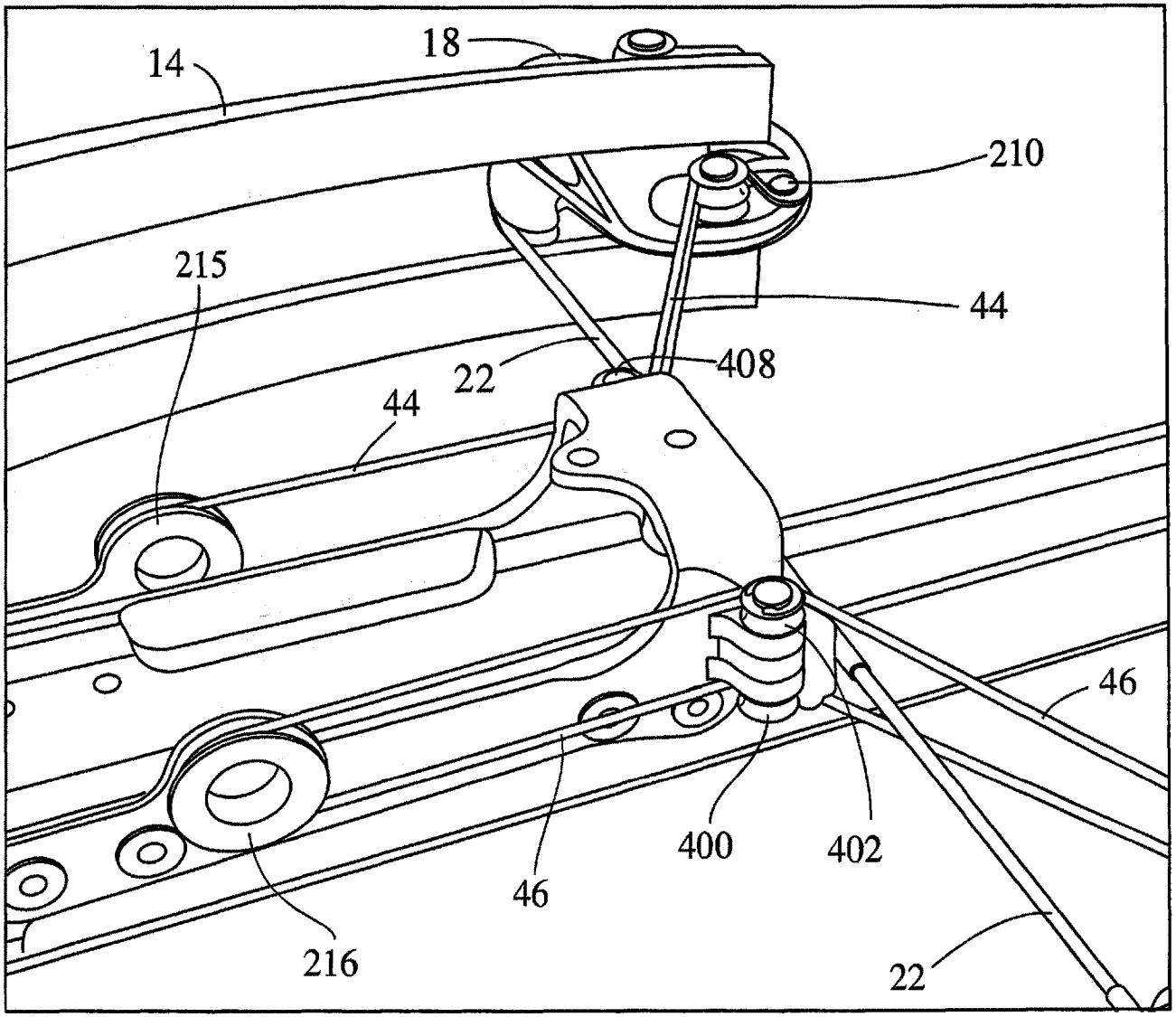
FIG. 2E is a second close up view of FIG. 2C of the present invention.

FIGS. 2C-2E, disclose a first and a second cable 44 and 46, each cable having a first end and a second end; and a first and a second cam 18 and 20. The first end of the first cable 44 is anchored to the first cam 18 and engages a first cable track of the first cam 18; the first cable 44 then spans to a first directional transition 408, (A component that alters the direction of the span. The directional transition may be of any smooth-surface that retains the cable.) The first cable 44 then spans to and is retained by a first cable pulley 215, the first cable 44 then spans to a second directional transition (not shown), then spans to engage a second cable track of the first cam 44, and the second end of the first cable 44 is anchored to the first cam 18. The first end of the second cable 46 is anchored to the second cam 20 and engages a first cable track of the second cam 20; the second cable 46 then spans to a third directional transition 402, then spans to and is retained by a second cable pulley 216, the second cable 46 then spans to a fourth directional transition 400, then spans to engage a second cable track of the second cam 20, and the second end of the second cable 46 is anchored to the second cam 20. The first and second directional transitions are a mirror of the third and fourth directional transitions 400, 402. The use of directional transitions allows for flexibility in design, and management of structural forces that would be impossible without them.

Figure 3:
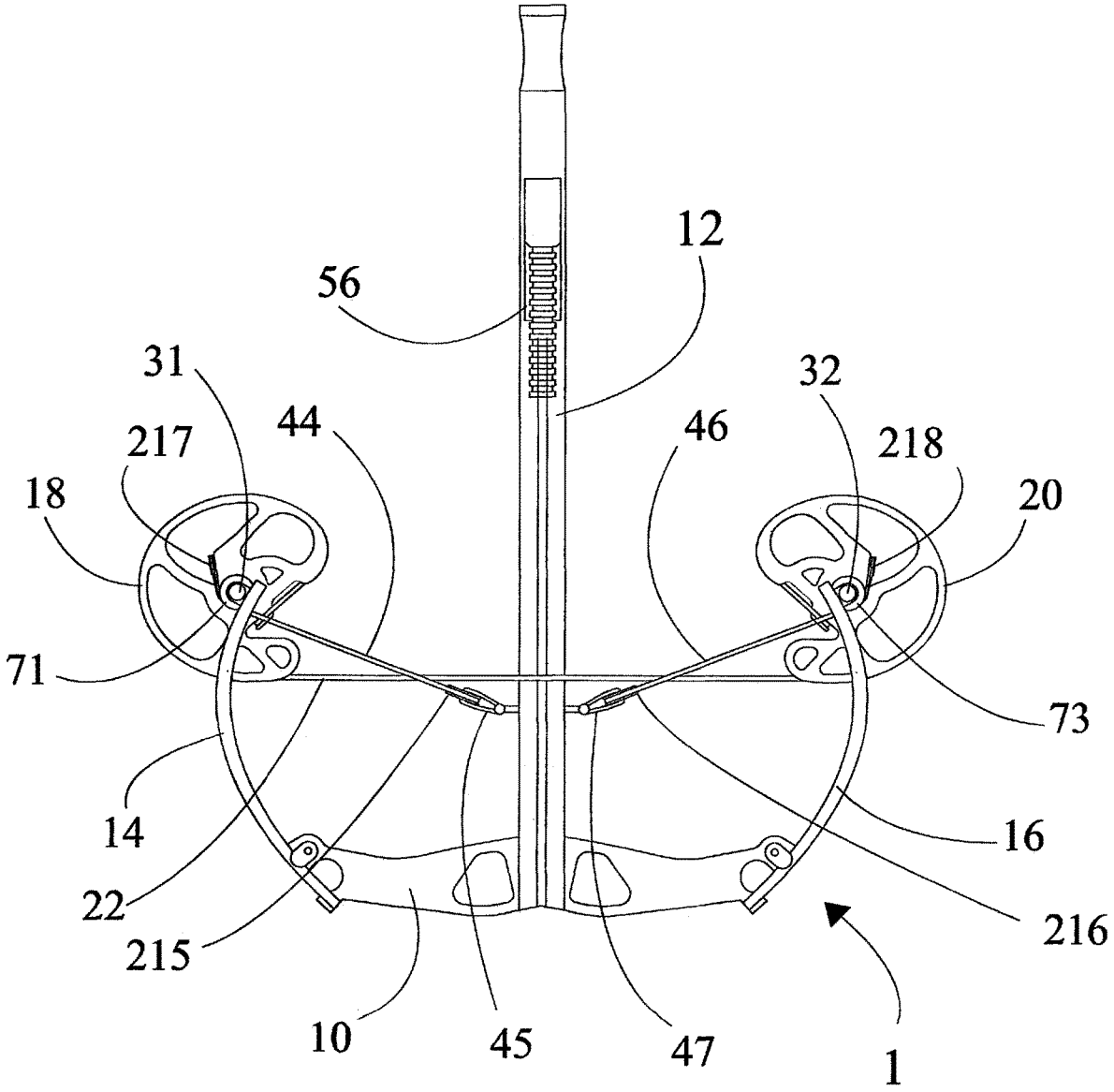
FIG. 3 is a top view of a conventional limb crossbow with inverted cams of the present invention in an at-rest position, having first and second cams; first and second cables; and a string, wherein opposing ends of the same cable are anchored to the same cam, and a mid-portion of the cables partially wrap a cable pulley of the present invention.
Figure 3A:
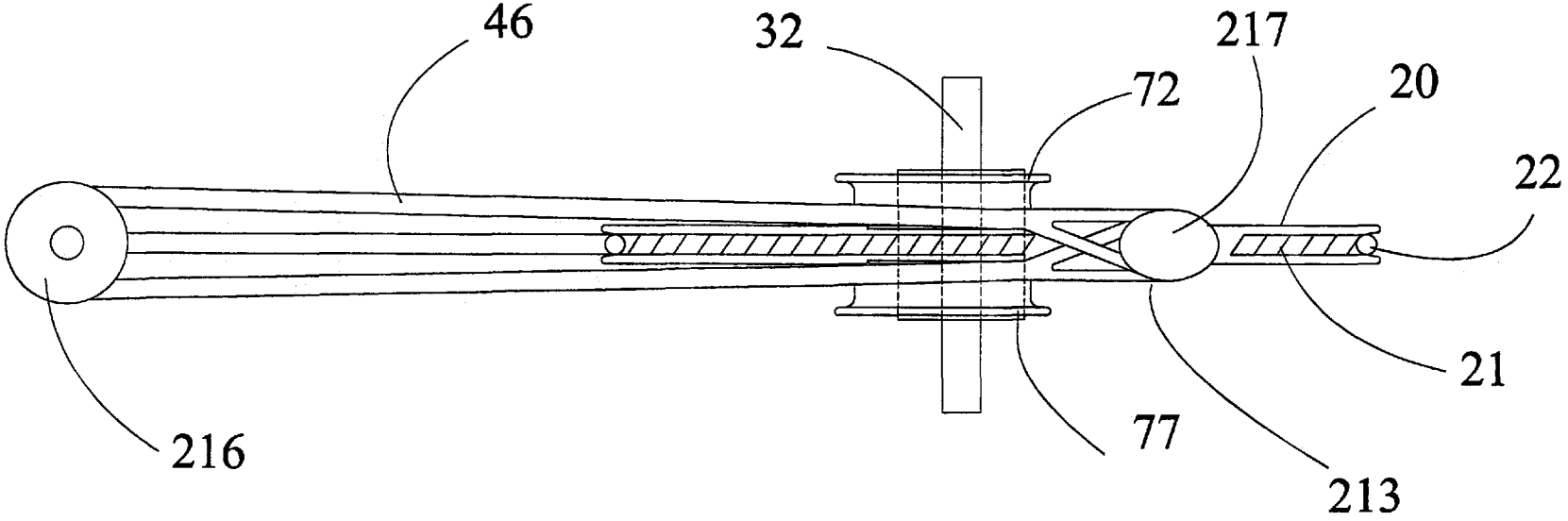
FIG. 3A is a side cut-away view of a second multi-piece cam with non-circular cable tracks of the present invention, having an upper and lower cable track that is at least twice as wide as the width of the cables; opposing ends of the second cable are anchored to the same post on the second cam, and a mid-portion of said second cable partially wraps a second cable pulley, a string and second cable are illustrated with the cam of the present invention.

With reference to FIG. 3, a similar crossbow is shown as relates to FIG. 2, however the first and second ends of the first cable 44 are anchored to a first cam single cable post 217 on a first cam 18, and the first and second ends of the second cable 46 are anchored to a second cam single cable post 218 on the second cam 20. FIG. 3A shows a partial cross section view of the crossbow of FIG. 3, wherein the first and second ends of cable 46 are anchored to a first cam 18 first cam single cable post 217.

Referring to FIGS. 4A-4J, the first cam 18 includes a first launch string track 19, a first cam upper cable track 40, a first cam launch string post 61, and a first cam lower cable track 41. A first end of the launch string 22 is retained by the first cam launch string post 61; a portion of the span of the launch string 22 at least partially wraps around the first cam 18 in the first cam launch string track 19; a portion of the span of the launch string 22 at least partially wraps the second cam 20 in the second cam launch string track 21, and a second end of the bowstring 22 is retained by the second cam launch string post 63.

The first end of the first cable 44 is coupled to the first cam first cable post 210; a segment of the first cable 44 partially engages the first cam upper cable track 40; the middle of the first cable 44 is retained by the first cable pulley 215 (not shown); a segment of the first cable 44 partially engages the first cam lower cable track 41; and the second end of the first cable 44 is coupled to the first cam second cable post 212. The first end of the second cable 46 is coupled to the second cam first cable post 211; a segment of the first cable 46 partially engages the second cam upper cable track 40; the middle of the first cable 46 is retained by the 216 (not shown); a segment of the second cable 46 partially engages the second cam lower cable track 41; and the second end of the second cable 46 is coupled to the second cam second cable post 213.

Figure 6A:
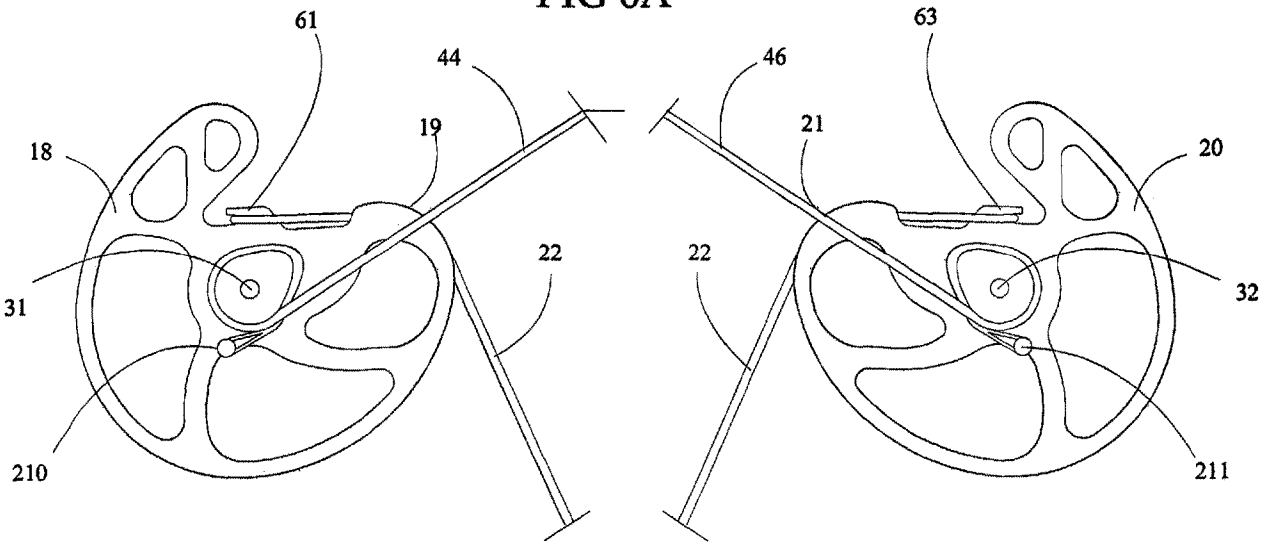
FIG. 6A is a top view of first and second multi-piece cams with non-circular cable tracks of the present invention; having an upper and lower cable track, modules have been removed for illustrative purposes; a string and cable are illustrated with the cam in a drawn position of the present invention.
Figure 6B:
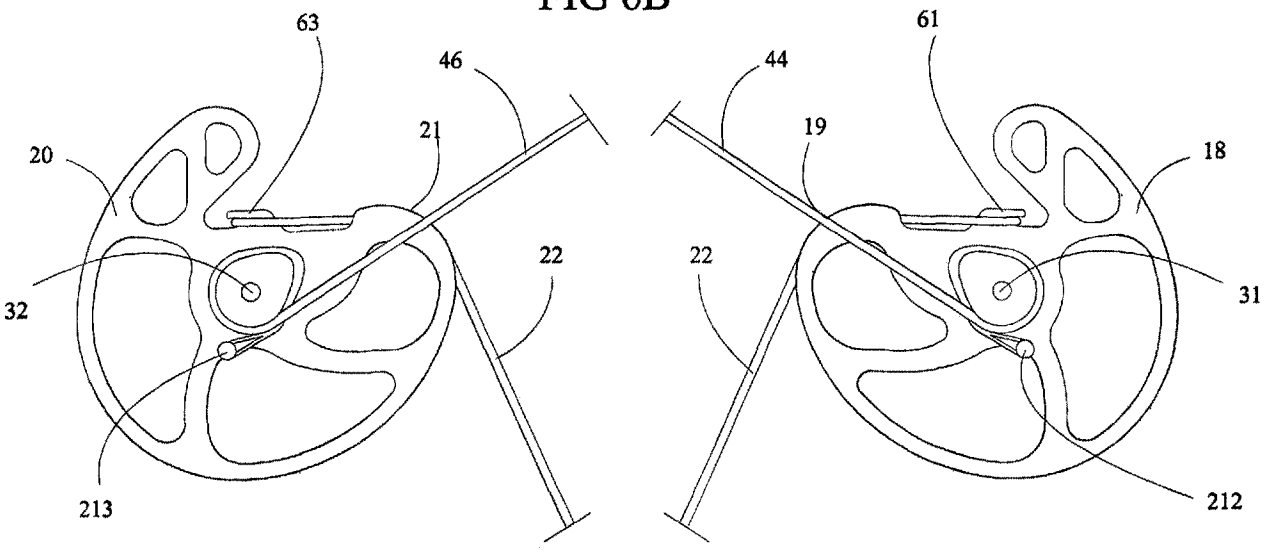
FIG. 6B is a bottom view of first and second multi-piece cams with non-circular cable tracks of the present invention, having an upper and lower cable, modules have been removed for illustrative purposes; a string and cable are illustrated with the cam in a drawn position of the present invention.

With reference to FIGS. 6A and 6B, when the launch string 22 is drawn from a rest position to a ready to fire position, the first cam 18 rotates in a first direction, and the second cam 20 rotates in a second direction. As the cams 18 and 20 rotate, the launch string 22 is unwound from the first and second launch string tracks 19 and 21. Simultaneously, the cables 44 and 46 wind into the first and second upper cable tracks 40 and 42 and the first and second lower cable tracks 41 and 43 of the first 18 and second 20 cams. When the launch string 22 has been drawn to the ready-to-fire position, it may be held in this the position by an operably releasable catch located in a housing 56. The first cable 44 is slide-able relative to the first cable pulley 215 and the second cable 46 is slide-able relative to the second cable pulley 216. The upper cable track 40, the lower cable track 41, the upper cable track 42 and the lower cable track 43 may be generally circular, or non-circular.

Figure 4A:
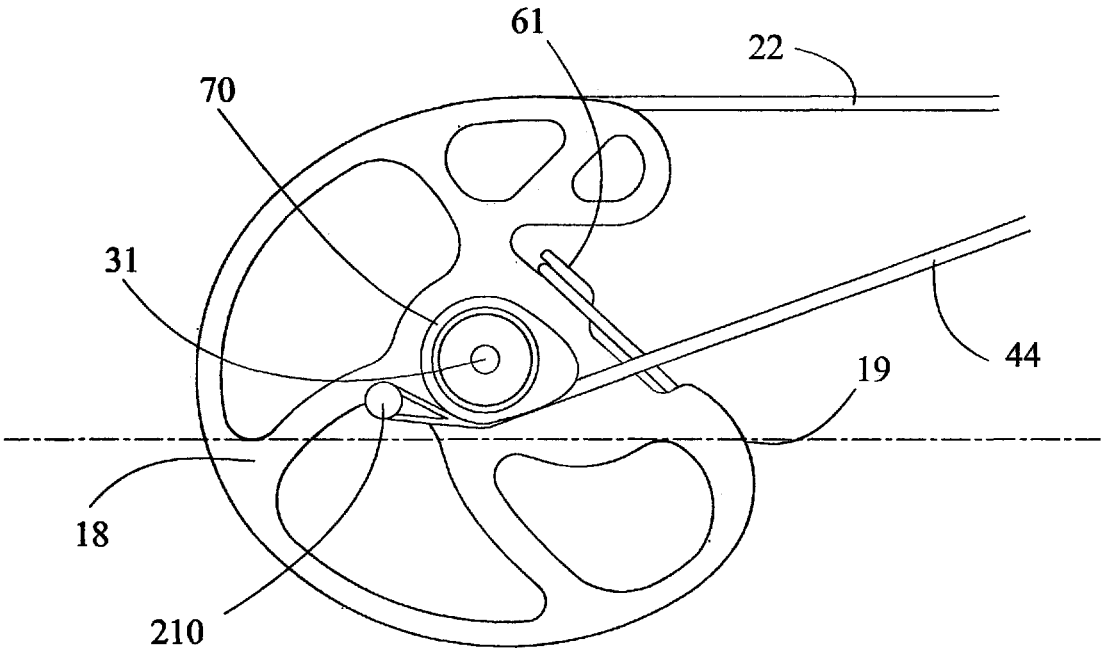
FIG. 4A is a top view of a first multi-piece cam with non-circular cable tracks of the present invention, a string and cable are illustrated with the cam of the present invention.
Figure 4B:
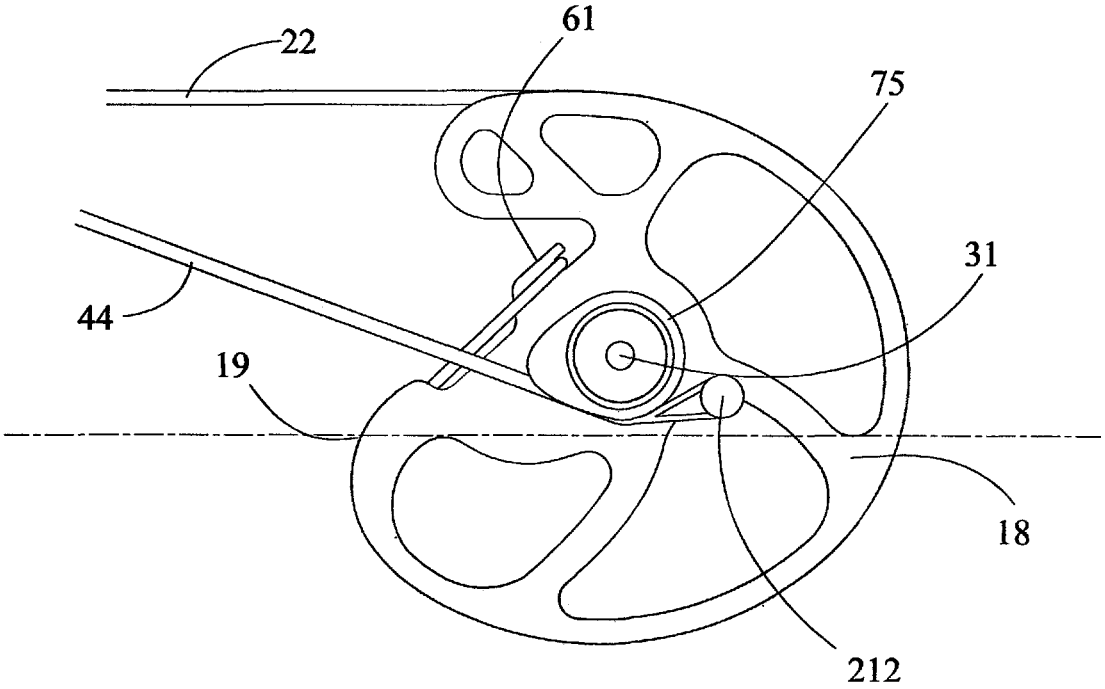
FIG. 4B is a bottom view of a first multi-piece cam with non-circular cable tracks of the present invention, a string and cable are illustrated with the cam of the present invention.
Figure 4E:
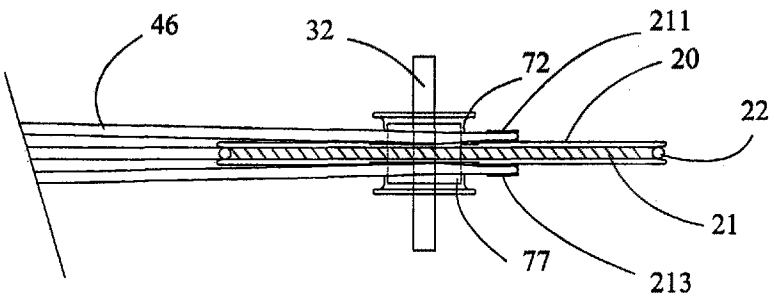
FIG. 4E is a side cut-away view of a second multi-piece cam with non-circular cable tracks of the present invention, having an upper and lower cable track, a string and cable are illustrated with the cam of the present invention.
Figure 4F:
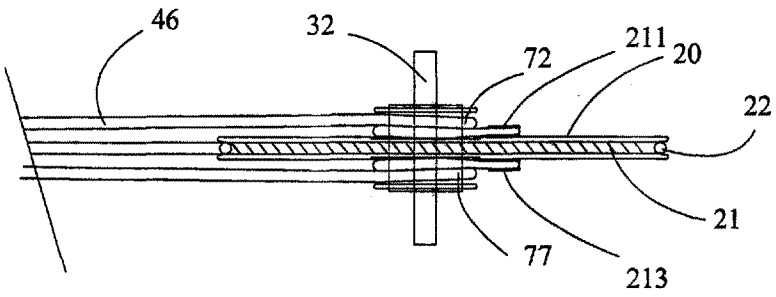
FIG. 4F is an exploded side view of a second multi-piece piece cam with non-circular cable tracks of the present invention having an upper and lower cable track, and having first and second mirror image modules of the present invention.
Figure 4C:
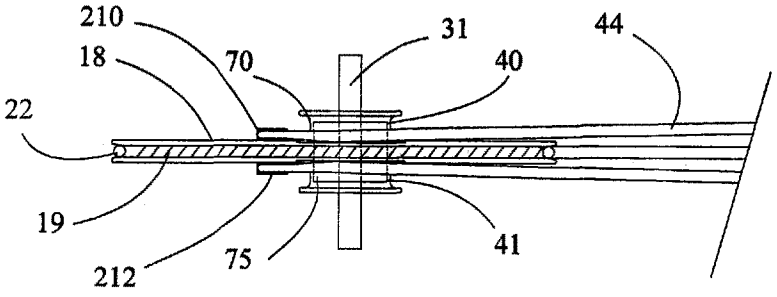
FIG. 4C is a side cut-away view of a first multi-piece cam with non-circular cable tracks of the present invention, having an upper and lower cable track, a string and cable are illustrated with the cam of the present invention.
Figure 4D:
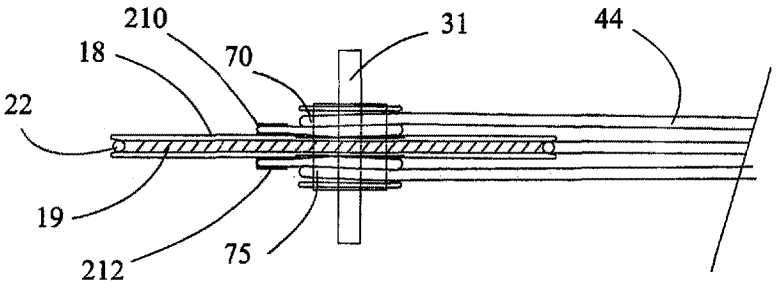
FIG. 4D is an exploded side view of a first multi-piece piece cam with non-circular cable tracks of the present invention having an upper and lower cable track, and having first and second mirror image modules of the present invention.
Figure 4I:
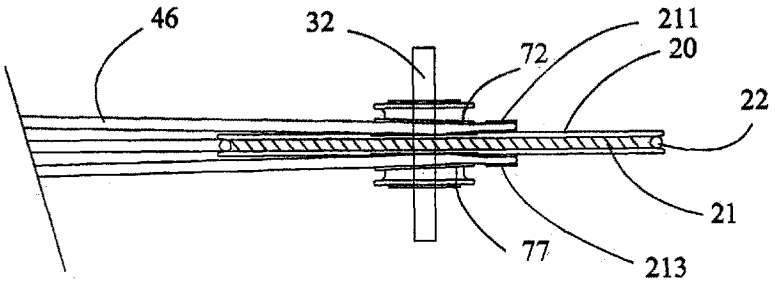
FIG. 4I is a side cut-away view of a second multi-piece cam with non-circular cable tracks of the present invention, having an upper and lower helical cable track, a string and cable are illustrated with the cam of the present invention.
Figure 4J:
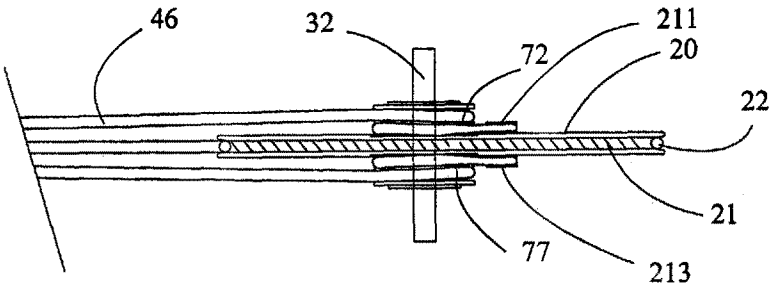
FIG. 4J is an exploded side view of a second multi-piece piece cam with non-circular cable tracks of the present invention having an upper and lower helical cable track, and having first and second mirror image modules of the present invention.
Figure 4G:
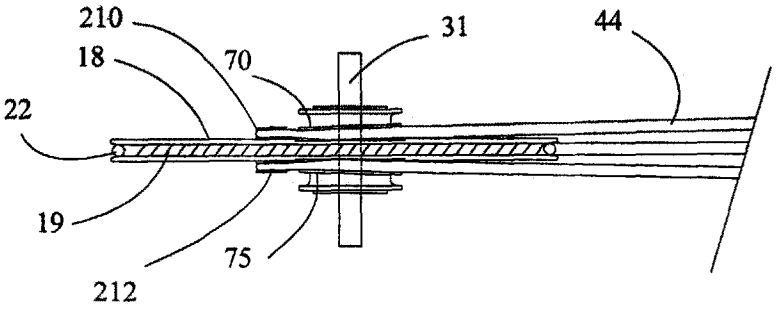
FIG. 4G is a side cut-away view of a first multi-piece cam with non-circular cable tracks of the present invention, having an upper and lower helical cable track, a string and cable are illustrated with the cam of the present invention.
Figure 4H:
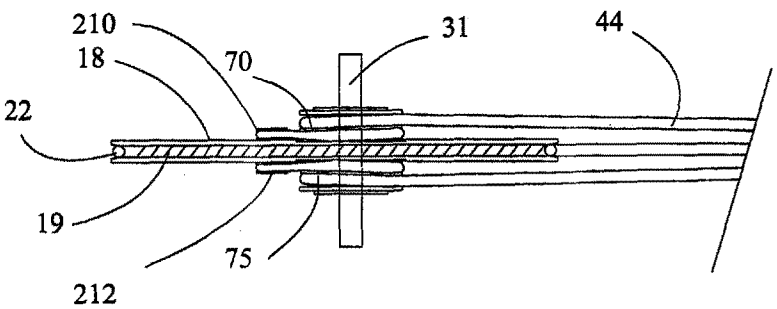
FIG. 4H is an exploded side view of a first multi-piece piece cam with non-circular cable tracks of the present invention having an upper and lower helical cable track, and having first and second mirror image modules of the present invention.

FIGS. 4A-4D and 5A-5D illustrate an embodiment of the first cam 18 of the current invention with string and cable(s), wherein the first cam 18 is constructed of a modular type construction. In this type of construction, the first and second side of the first cam 18 and the second cam 20 are mirror images of each other, and the first cam 18 is identical and interchangeable with the second cam 20. The first cam 18 includes a first module 70 and a second module 75. The first and second modules 70, 75 are mirror images of each other. The first and second modules 70, 75 are identical and are interchangeable with a first module 72 and a second module 77 of the second cam 20. Specifically, FIG. 4A is a top view of the first cam 18, FIG. 4B is a bottom view of the first cam 18, FIG. 4C is a cut-away view of the first cam 18 with the string 22 and the cable 44. The first module 70 and the second module 75 may be generally non-circular, or circular.

FIGS. 4G-4J illustrate an alternate embodiment of the first cam 18 of the current invention with string and cable(s), wherein the first cam 18 is constructed of a modular type construction. In this type of construction, the first and second side of the first cam 18 and the second cam 20 are mirror images of each other, and the first cam 18 is identical and interchangeable with the second cam 20. The first cam 18 includes a first helical module 70 and a second helical module 75. The first and second helical modules 70, 75 are mirror images of each other. The first and second helical modules 70, 75 are identical and are interchangeable with a first module 72 and a second module 77 of the second cam 20.

Figure 5A:
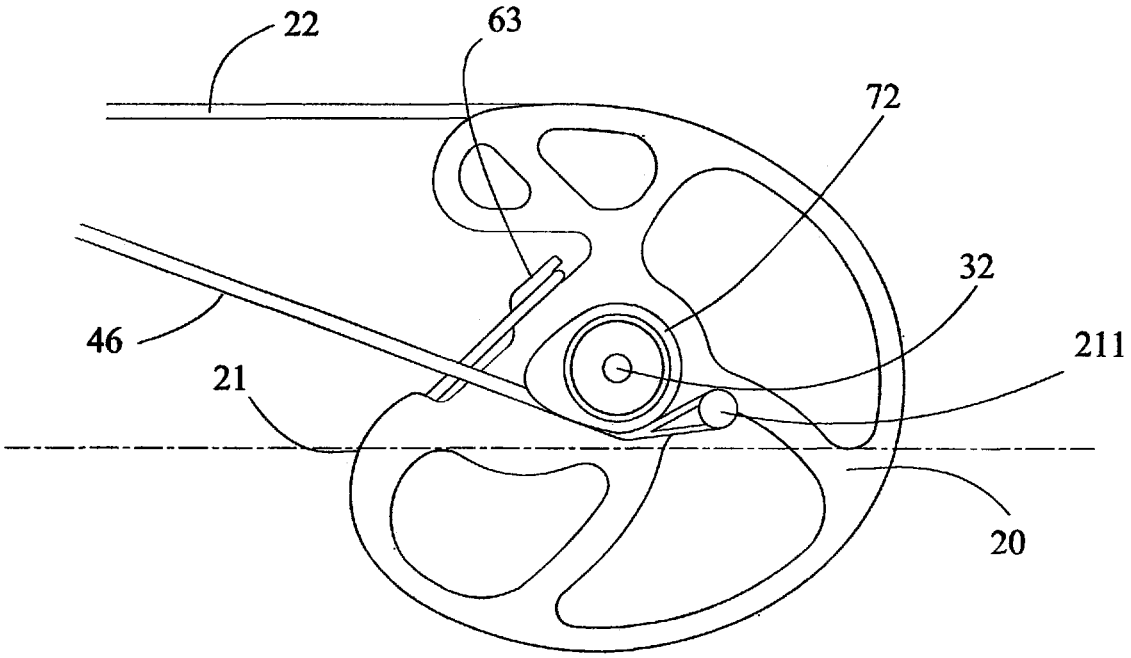
FIG. 5A is a top view of a second multi-piece cam with non-circular cable tracks of the present invention, a string and cable are illustrated with the cam of the present invention.
Figure 5B:
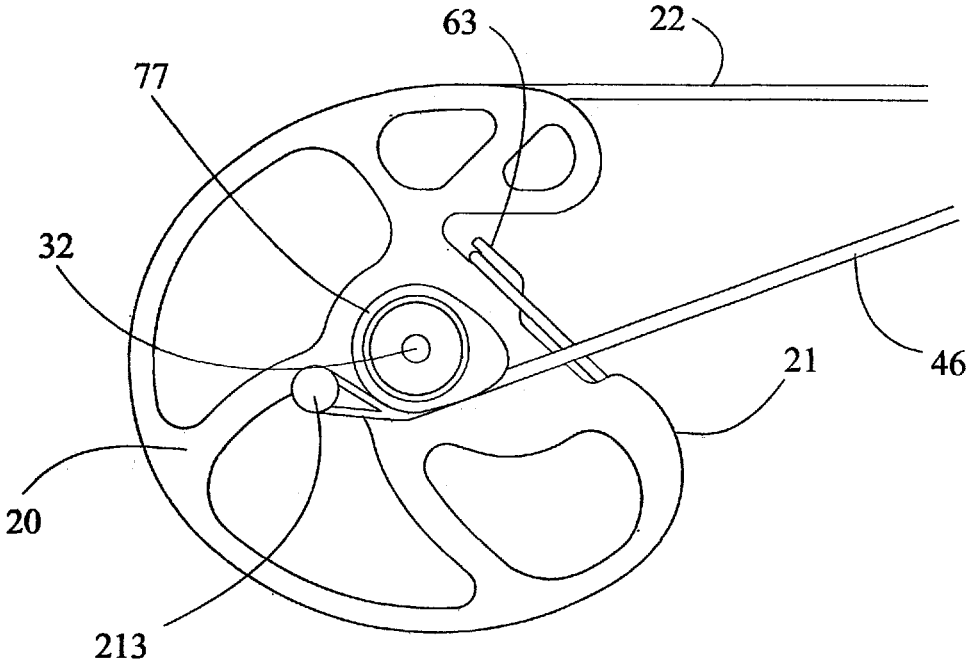
FIG. 5B is a bottom view of a second multi-piece cam with non-circular cable tracks of the present invention, a string and cable are illustrated with the cam of the present invention.
Figure 5C:
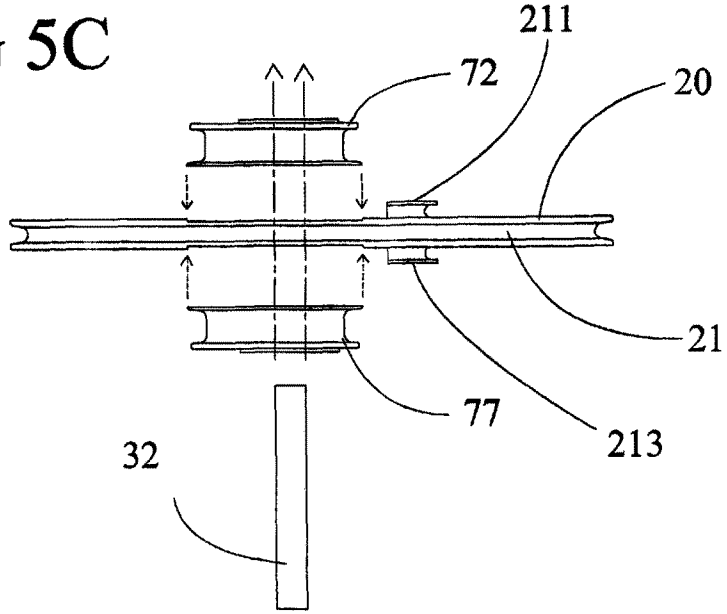
FIG. 5C is an exploded side view of a second multi-piece piece cam with non-circular cable tracks of the present invention having an upper and lower cable track that, and having a first and second mirror image modules of the present invention.
Figure 5D:
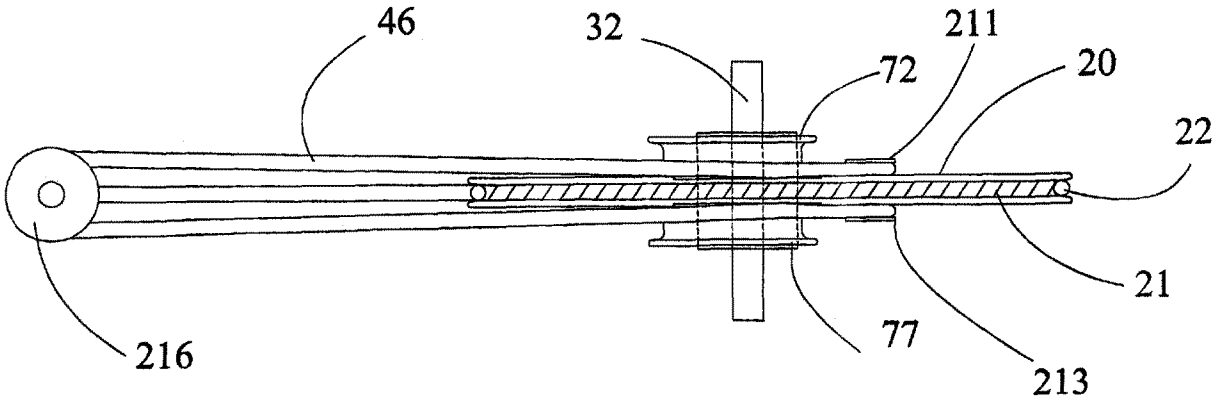
FIG. 5D is a side cut-away view of a second multi-piece cam with non-circular cable tracks of the present invention, having an upper and lower cable track; opposing ends of the second cable are anchored to the second cam, and a mid-segment of said second cable partially wraps a second cable pulley, a string and second cable are illustrated with the cam of the present invention.
Figure 5E:
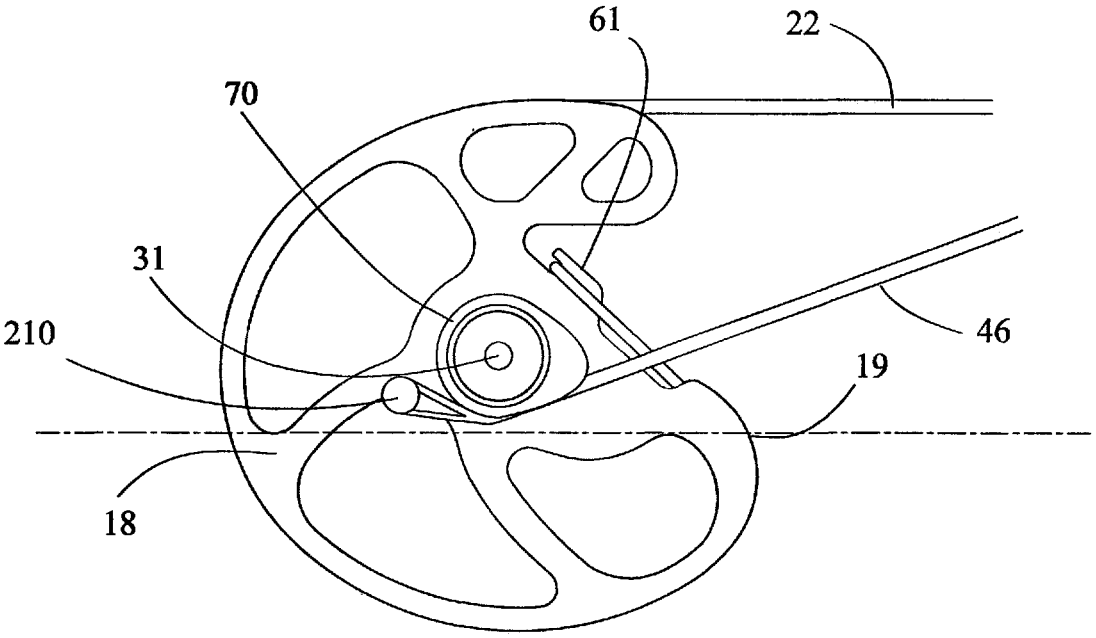
FIG. 5E is a top view of a first multi-piece cam with non-circular cable tracks of the present invention, a string and cable are illustrated with the cam of the present invention.
Figure 5F:
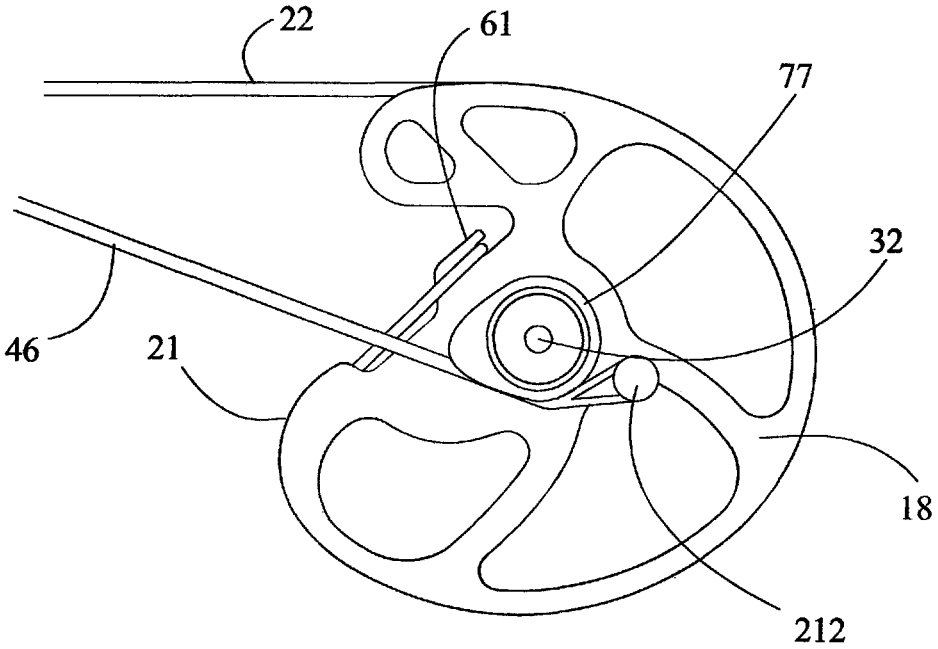
FIG. 5F is a bottom view of a first multi-piece cam with non-circular cable tracks of the present invention, a string and cable are illustrated with the cam of the present invention.
Figure 5G:
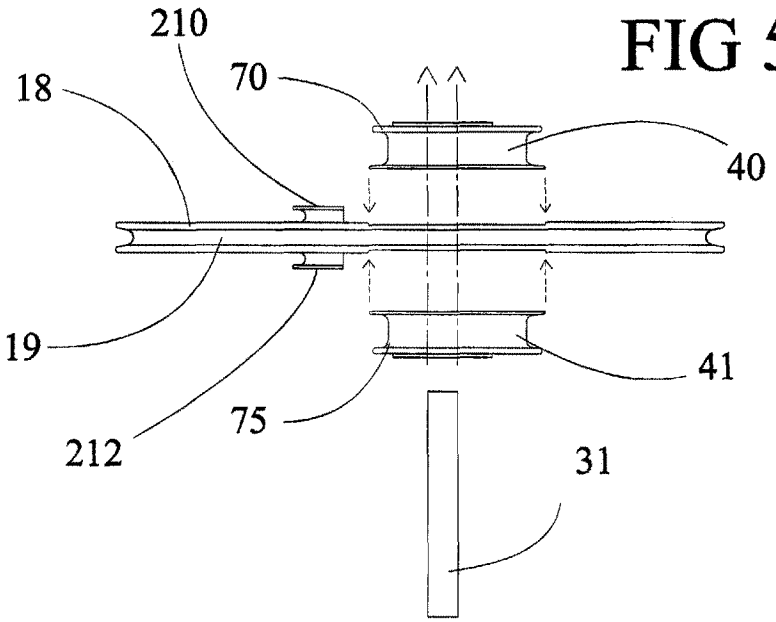
FIG. 5G is an exploded side view of a first multi-piece piece cam with non-circular cable tracks of the present invention having an upper and lower cable track, and having a first and second mirror image modules of the present invention.
Figure 5H:
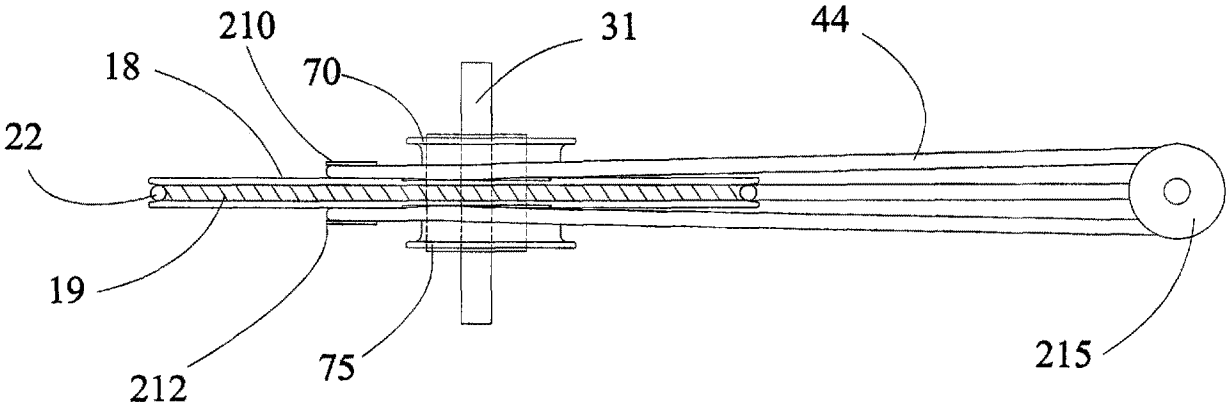
FIG. 5H is a side cut-away view of a first multi-piece cam with non-circular cable tracks of the present invention, having an upper and lower cable track; opposing ends of the first cable are anchored to the first cam, and a mid-segment of said first cable partially wraps a first cable pulley, a string and first cable are illustrated with the cam of the present invention.

FIGS. 5A-5D illustrate an embodiment of the second cam 20 of the current invention, with string and cable(s), wherein the second cam 20 is constructed of a modular type construction. In this type of construction, the first and second side of the second cam 20 and the first cam 18 are mirror images of each other, and the first cam 18 is identical and interchangeable with the second cam 20. The first module 72 and the second module 77 are mirror images of each other, and the first and second modules 70 and 75 are identical and interchangeable with the first and second modules 72 and 77. Specifically, FIG. 5A is a top view of the second cam 20, FIG. 5B is a bottom view of the second cam 20, FIG. 5C is a cut-away view of a second cam with the string 22 and the cable 46. The first module 72 and the second cable module 77 may be generally non-circular, or circular. FIG. 6A illustrates a top view of the first cam 18 and the second cam 20, in the drawn position. FIG. 6B illustrates a bottom view of the first cam 18 and the second cam 20, in the drawn position. FIGS. 6A and 6B are identical to each other and not just mirror images, as described previously in FIGS. 5A-5D. This feature allows for an easier method of manufacture and assembly.

A first end of the launch string 22 is anchored to the first cam string post 61; a segment of the launch string 22 partially wraps cam 18 in the string track 19; the string crosses the center of the riser 10; and partially wraps the second cam 20 in the string track 21; and the second end of the launch string 22 is anchored to the second cam string post 63.

With reference to FIGS. 4A-4D and 5A-5D, the mid-segment of the first and second cables 44, 46 "slidably" engage the first and second cable pulleys 215 and 216, which allows the first and second cables 44, 46 to self-center themselves relative to a first side and a second side of the first and second cams 18 and 20. The self-centering feature of the cables 44, 46 provides for automatic cable timing, which eliminates cam lean, and timing issues. As the launch string 22 is drawn, the launch string unwraps, or "pays out" from the first and second cams 18, 20. Simultaneously, the first and second cables 44, 46 wrap the respective first cable tracks 70, 75 and the second cable tracks 72, 77.

It is preferable that the second ends of the first and second cables 44 and 46 not be anchored to the same post. However the first and second cables 44, 46 will still function satisfactorily if anchored to the same post.

With reference to FIGS. 7, 7A, 7B, and 7C, the first cable 44 is coupled with the first cam 18. A first end 44*a* is anchored to the first cam 18, a first segment 44*b* is engaged with a first cable track 40, a mid-segment 44*c* is engaged with a first pulley (not shown), a second segment (not shown) is engaged with a second cable track (not shown), and a second cable end (not shown) is anchored to the first cam 18.

The second cable 46 is coupled with the second cam 20. A first end 46*a* is anchored to the second cam 20, a first segment 46*b* is engaged with a first cable track 40, a mid-segment 46*c* is engaged with a first pulley (not shown), a second segment (not shown) is engaged with a second cable track (not shown), and a second cable end (not shown) is anchored to the second cam 20.

Figure 7:
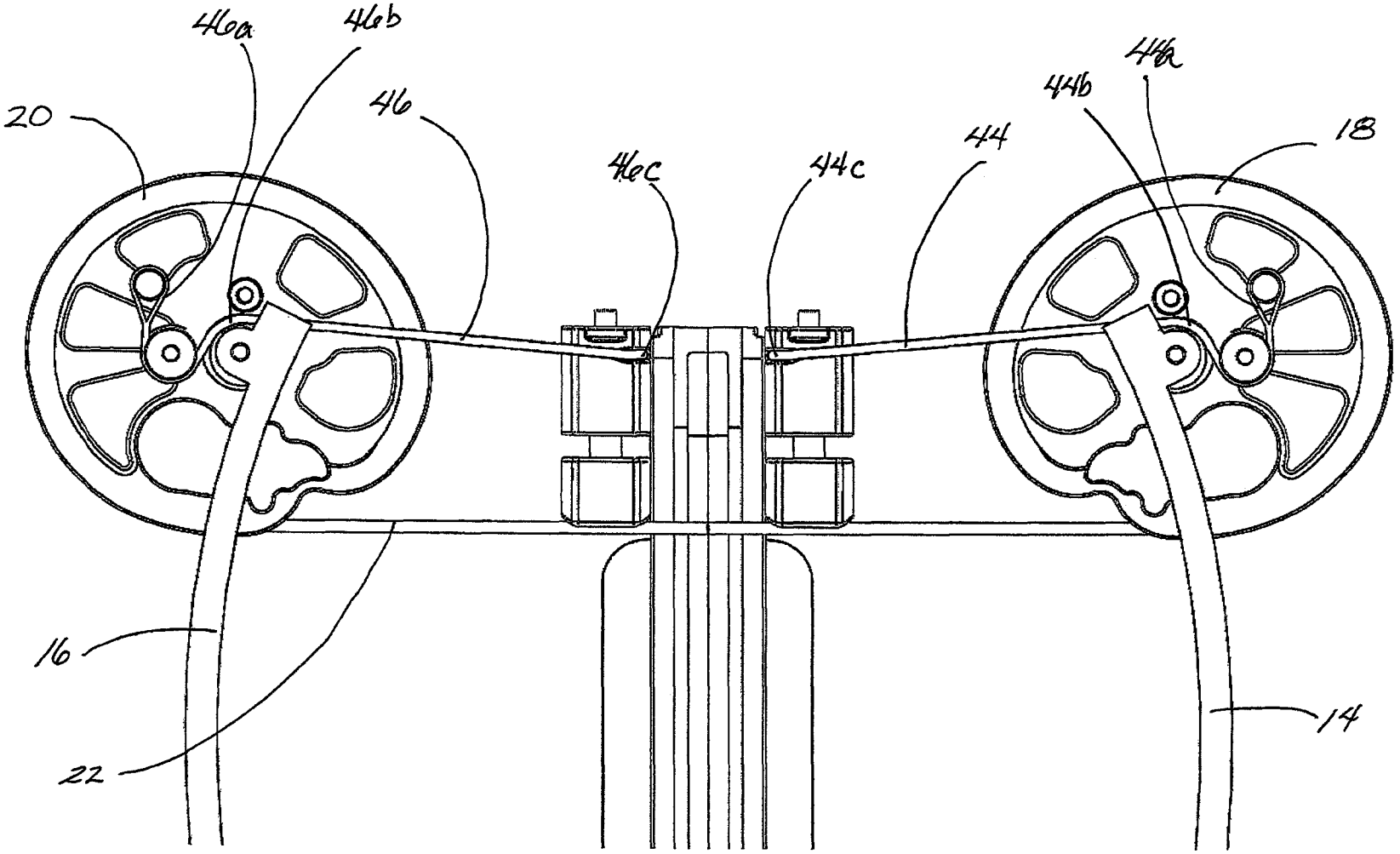
FIG. 7 is a partial top view having a first cable coupled with a first cam and a second cable coupled with a second cam, wherein the cable ends are anchored on the cams and the bow is uncocked of the present invention
Figure 7A:
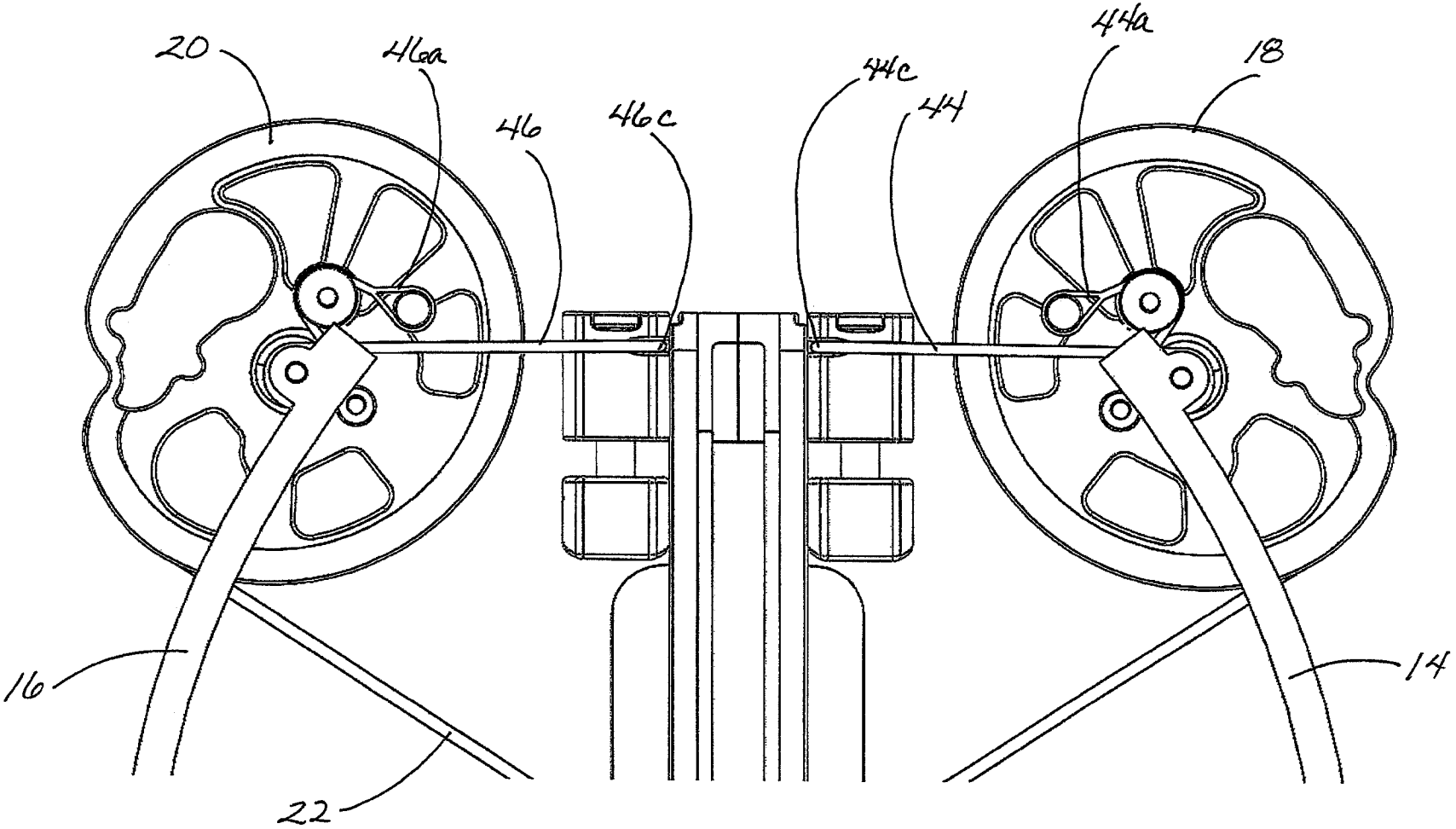
FIG. 7A is a partial top view having a first cable coupled with a first cam and a second cable coupled with a second cam, wherein the cable ends are anchored on the cams and the bow is cocked of the present invention
Figure 7B:
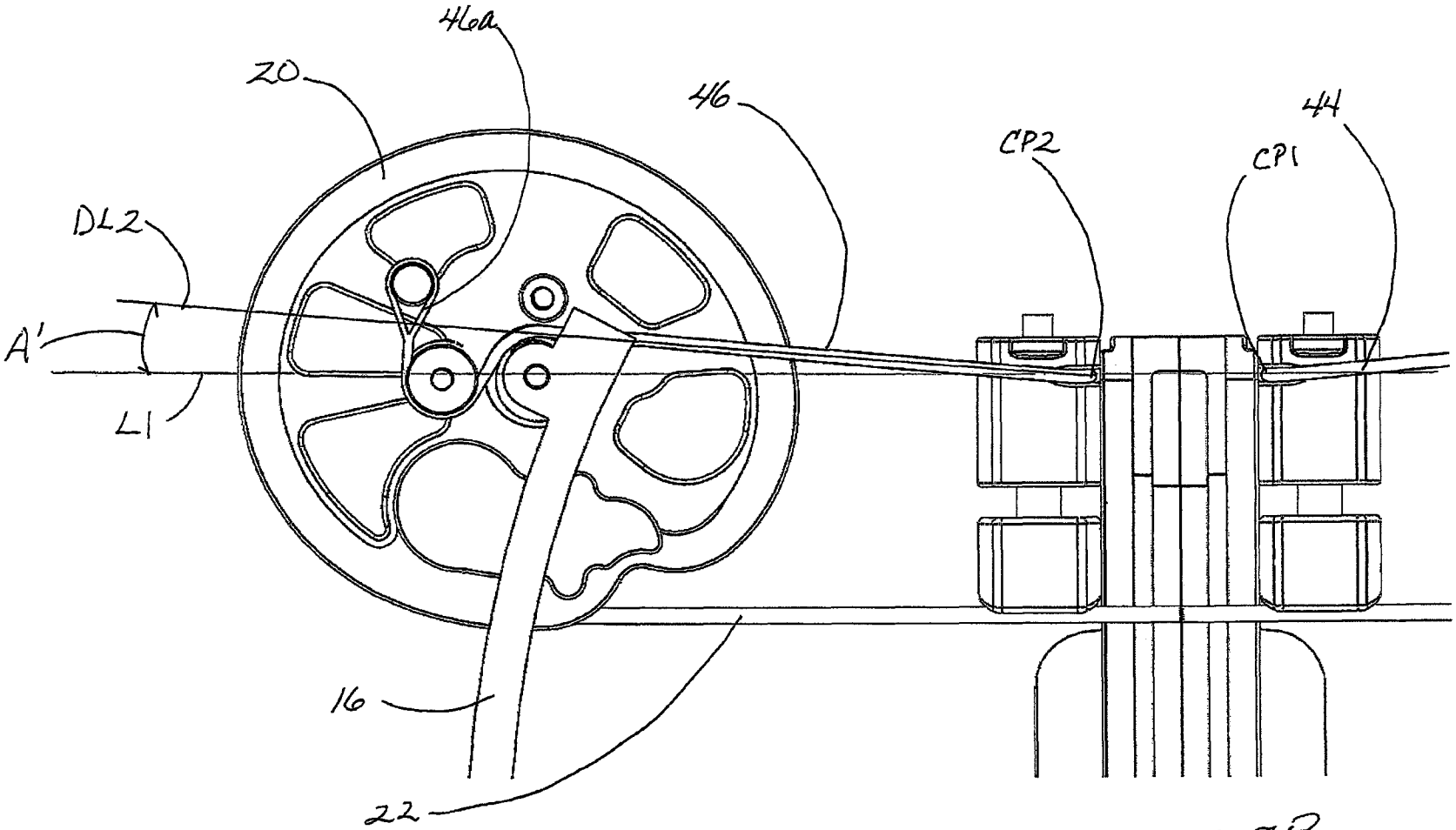
FIG. 7B is a partial top view having a first cable coupled with a first cam and a second cable coupled with a second cam, wherein the cable ends are anchored on the cams and the bow is uncocked of the present invention

Referring specifically to FIG. 7B, mid segments 44*b* and 46*b* transition the first cable 44 and second cable 46 from a first side of cams 18 and 20 to the second side of cams 18 and 20. A line L1 is drawn between the location of the center point of the first cable CP1 and the location of the center point of the second cable CP2. Line L1 is parallel with the bowstring 22 when the bow is uncocked. A departure line DL2 is drawn from CP2 to the center of the cable at the departure point DP2 wherein the first segment 46*b* of the second cable 46 disengages from the first cable track 40 of the second cam 20. The angle A' between lines L1 and DL2 when the bow is uncocked is measured in degrees. It is preferred that this angle is less than about thirty degrees, and most preferably zero degrees.

A line L1 is drawn between the location of the center point of the first cable CP1 and the location of the center point of the second cable CP2. Line L1 is parallel with the bowstring 22 when the bow is uncocked. A departure line DL2 is drawn from CP2 to the departure point DP2 wherein the first segment 46*b* of the second cable 46 disengages from the first cable track 40 of the second cam 20. The angle A' between lines L1 and DL2 when the bow is uncocked is measured in degrees. It is preferred that this angle is less than about thirty degrees, and most preferably zero degrees.

Figure 7C:
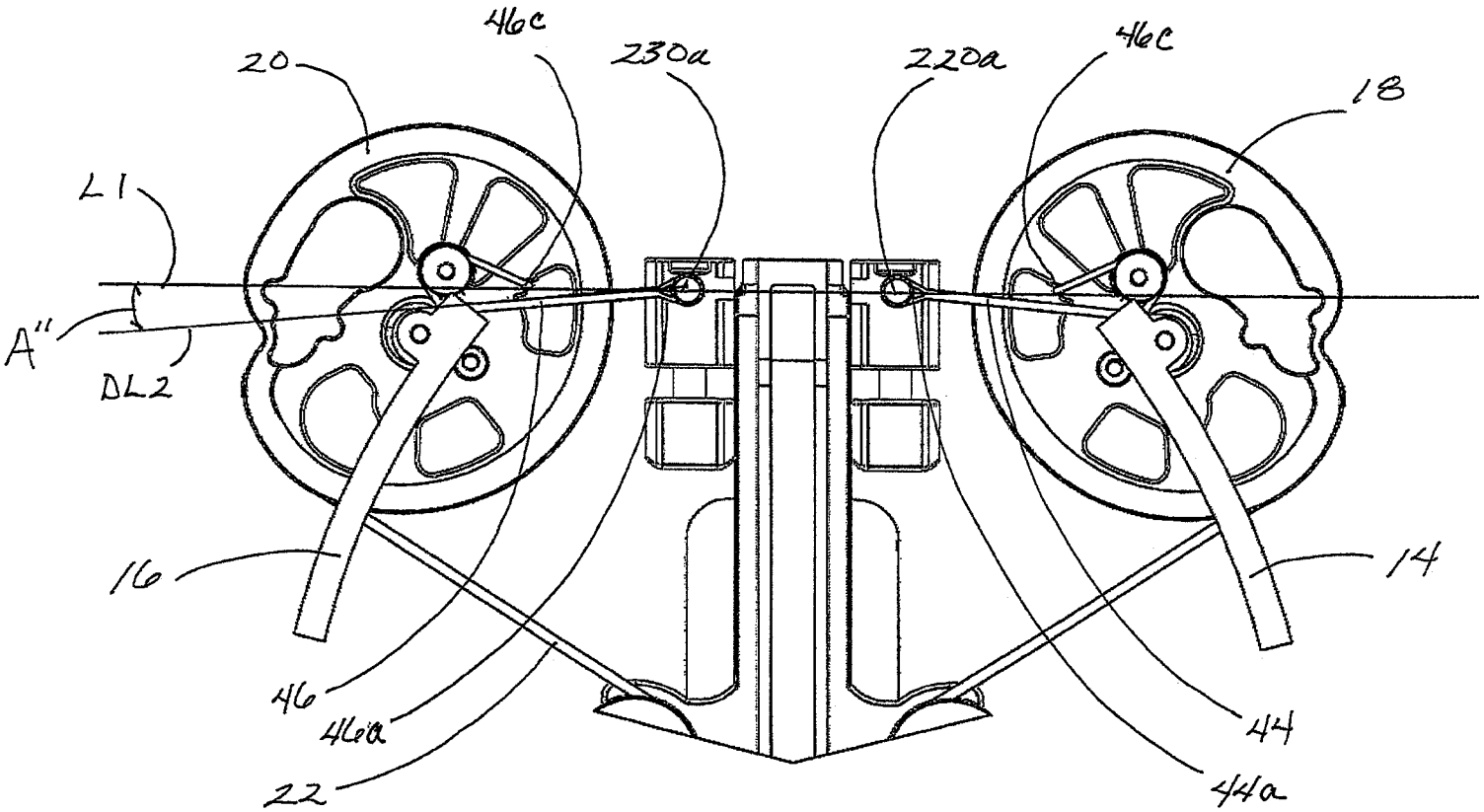
FIG. 7C is a partial top view having a first cable coupled with a first cam and a second cable coupled with a second cam, wherein the cable ends are anchored adjacent the cams and the bow is cocked of the present invention

Referring specifically to FIG. 7C, an alternative embodiment is shown with the bow in the cocked position. A first end 44*a* of the first cable 44 is anchored to a first cable post 220*a* adjacent the first cam 18. A first segment 44*b* engages a first cable track 40, a mid-segment 44*c* transitions the first cable 44 from a first side of cam 18 to the second side of cam 18 by passing through an opening portal in the cam, a second segment (not shown) engages a second cable track (not shown) of the first cam 18, and the second end (not shown) of the first cable 44 is anchor to a second cable post (not shown) adjacent the first cam 18.

A first end 46*a* of the second cable 46 is anchored to a third cable post 220*a* adjacent the second cam 20. A first segment 46*b* engages a first cable track 40 of the second cam 20, a mid-segment 46*c* transitions the second cable 46 from a first side of cam 20 to the second side of cam 20 by passing through an opening portal in the cam 20, a second segment 46*d* engages a second cable track 41 of the second cam 20, and the second end 46*e* of the first cable 46 is anchored to a fourth cable post 230*b* adjacent the second cam 20.

A line L1 is drawn between the location of the center point of the first cable post 220*a* and the location of the center point of the third cable post 230*a*. Line L1 is parallel with the bowstring 22 when the bow is uncocked. A departure line DL2 is drawn from center point of the third cable post 230*a* to the departure point DP2 wherein the first segment 46*b* of the second cable 46 disengages from the first cable track 40 of the second cam 20. The angle A' between lines L1 and DL2 when the bow is uncocked is measured in degrees. It is preferred that this angle is less than about thirty degrees, and most preferably zero degrees. When the bow is cocked, it is preferred that the angle A" between lines L1 and DL2 is less than about thirty degrees.

It is preferred that when the bowstring is at rest, line L1 and a line drawn from DP1 to DP2 are in line with each other. This unique feature provides for the least amount of shock.

Referring again to FIGS. 7, 7A, and 7B the current disclosure, a reverse draw style crossbow having FFL and non-inverted cams having the bowstring unwind from the rear of the cams, and the cables are engaged with the cams forward the cam axles. There is only one cable per cam, each cable having a first end and a second end, a first adjacent segment and a second adjacent segment, a first span, a mid-segment, and a second span. Both ends of the first cable are anchored to the first cam, and both ends of the second cable are anchored to the second cam. When the crossbow is uncocked, the first and second cables' first span and second span partially engage the corresponding cable tracks on opposite sides of the string tracks, then disengage the cable tracks at a departure point (DP1 and DP2). The first cable first span and second span are parallel to each other on a vertical plane, and the second cable first span and second span are parallel to each other on a vertical plane, in that when the crossbow is viewed from directly above or directly below, only a single span is visible of each cable. The first cable first span and second span may or may not be parallel to each other on a horizontal plane, and the second cable first span and second span may or may not be parallel to each other on a horizontal plane, in that when the crossbow is viewed from the front or rear, the spans may or may not be parallel to each other.

The mid segment of the first cable engages a first cable pulley, and the mid segment of the second cable engages a second cable pulley. The first adjacent segment engages a first cable track on a first side of the first cam and a second adjacent segment engages at the second cable track on a second side of the cam.

A line L1 is drawn centered on the center of the first cable where the first cable is retained by the first cable pulley (CP1) and the center of the second cable where the second cable is retained by the second cable pulley (CP2), and extends outwardly in both directions. In an alternate embodiment, RP1 (Retainment Point) and RP2 also indicate the retainment position of the ends of the cables adjacent the cams.

In a first preferred embodiment, when the crossbow is in an uncocked position, a line drawn between DP1 and DP2 is in line with L1, and when the crossbow is in the cocked position, the angle A" between L1 and the first and second segments of the first cable and the first and second segments of the second cable as measured from DP1 to CP1 and from DP2 to CP2 are no more than about minus thirty degrees.

In a second preferred embodiment, when the crossbow is in an uncocked position, a line drawn between DP1 and DP2 is in line with L1, and when the crossbow is in the cocked position, the angle A" between L1 and the first and second segments of the first cable and the first and second segments of the second cable as measured from DP1 to CP1 and from DP2 to CP2 are no more than about minus thirty degrees.

In a third preferred embodiment, when the crossbow is in an uncocked position, the angle A' between L1 and the first and second segments of the first cable and the first and second segments of the second cable as measured from DP1 to CP1 and from DP2 to CP2 are no more than about fifteen degrees. When the crossbow is in more or less the half-cocked position, L1 and the first and second segments of the first cable and the first and second segments of the second cable are in line with each other, and when the crossbow is in the cocked position, the angle A" between L1 and the first and second segments of the first cable and the first and second segments of the second cable as measured from DP1 to CP1 and from DP2 to CP2 are no more than about minus fifteen degrees.

An alternative embodiment is similar the preferred embodiment, with the exception that the cable spans do not have to be in line with L1 when the bow is cocked or half-cocked, however the angle variation between cocked as measured from DP1 to CP1 and from DP2 to CP2 are no more than about thirty degrees. Further, the cable ends may not be anchored to the cams, in that the ends are anchored relative to the frame, and the mid-section of the cables passes through the cam body.

Figure 8:
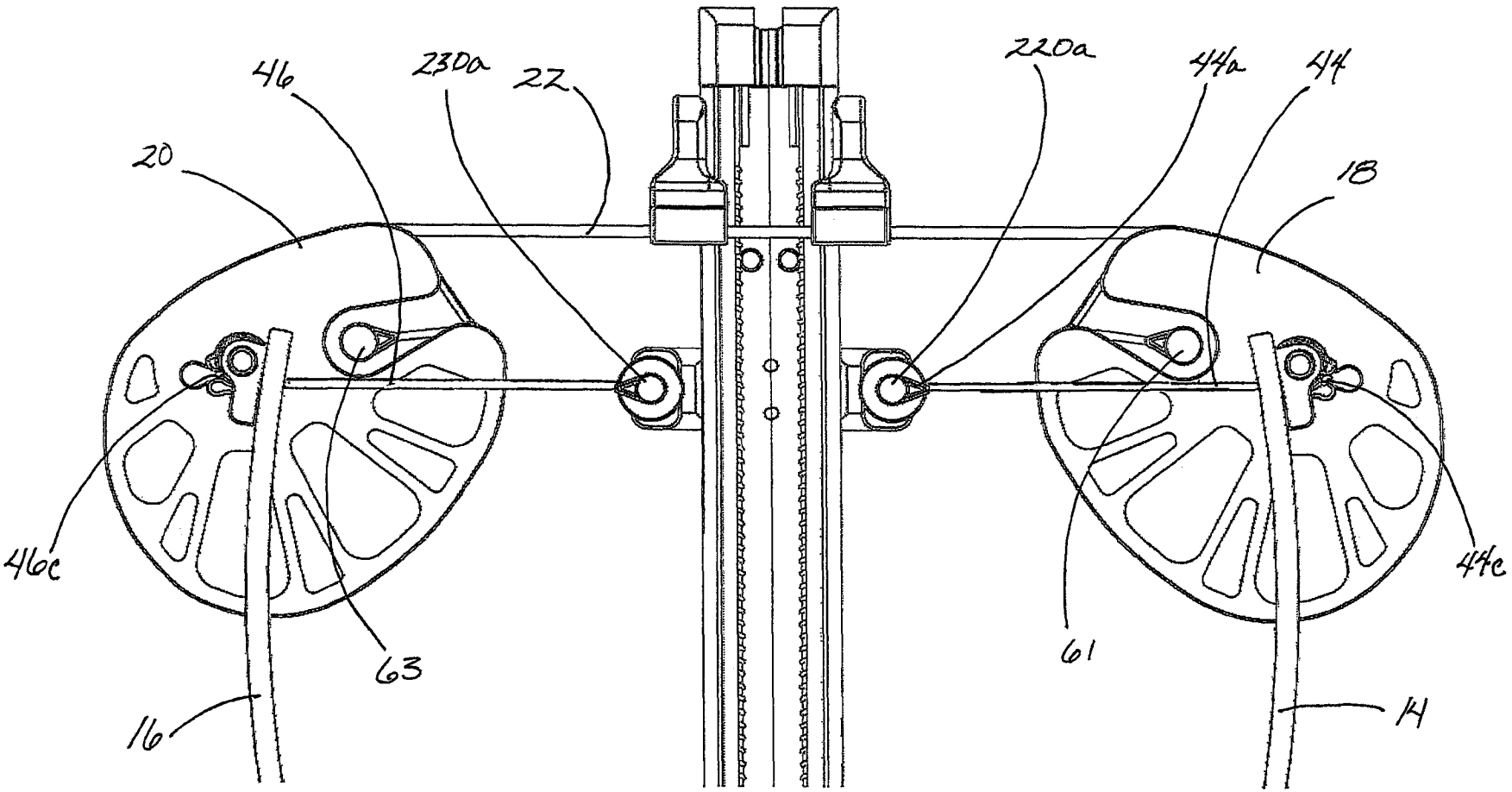
FIG. 8 is a partial top view of an uncocked projectile launching device having forward facing limbs, a single cable per cam, cable ends anchored adjacent the cams, and the mid-segment of the cables passing through a portal of the cams of the present invention.
Figure 8A:
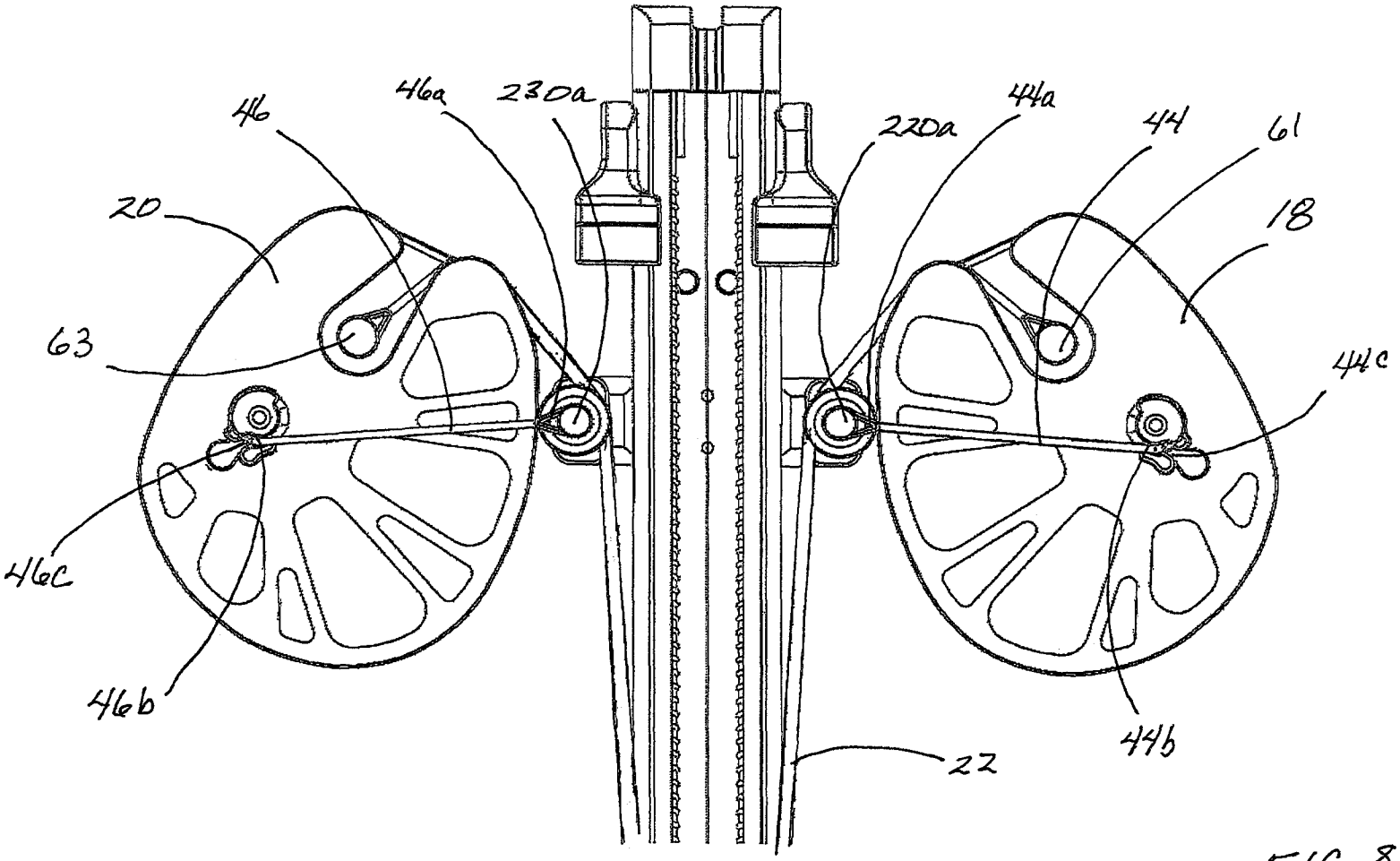
FIG. 8*a* is a partial top view of a cocked projectile launching device having forward facing limbs, a single cable per cam, cable ends anchored adjacent the cams, and the mid-segment of the cables passing through a portal of the cams of the present invention.
Figure 8B:
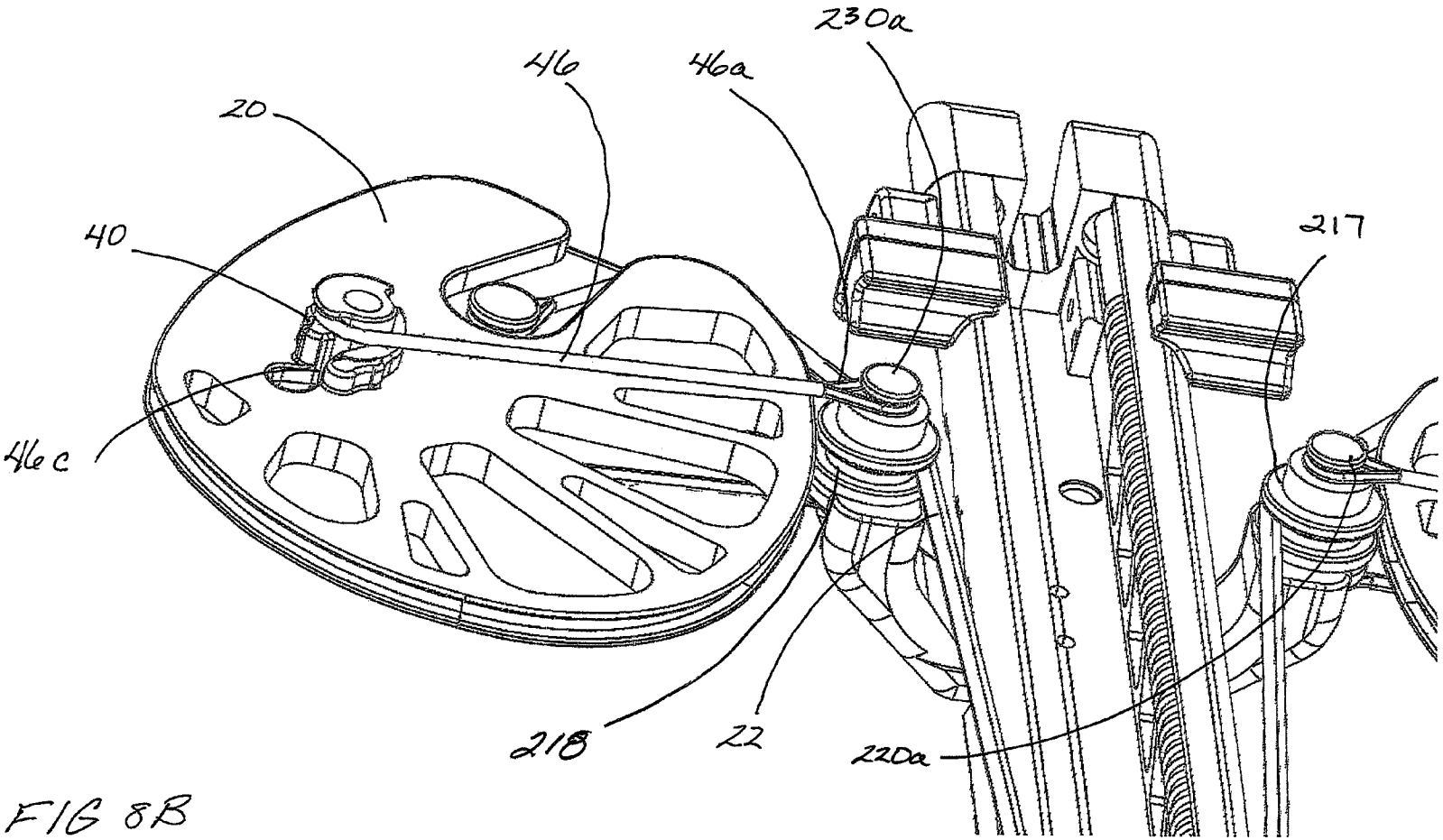
FIG. 8*b* is a partial perspective view of a cocked projectile launching device having forward facing limbs, a single cable per cam, cable ends anchored adjacent the cams, and the mid-segment of the cables passing through a portal of the cams of the present invention.
Figure 8C:
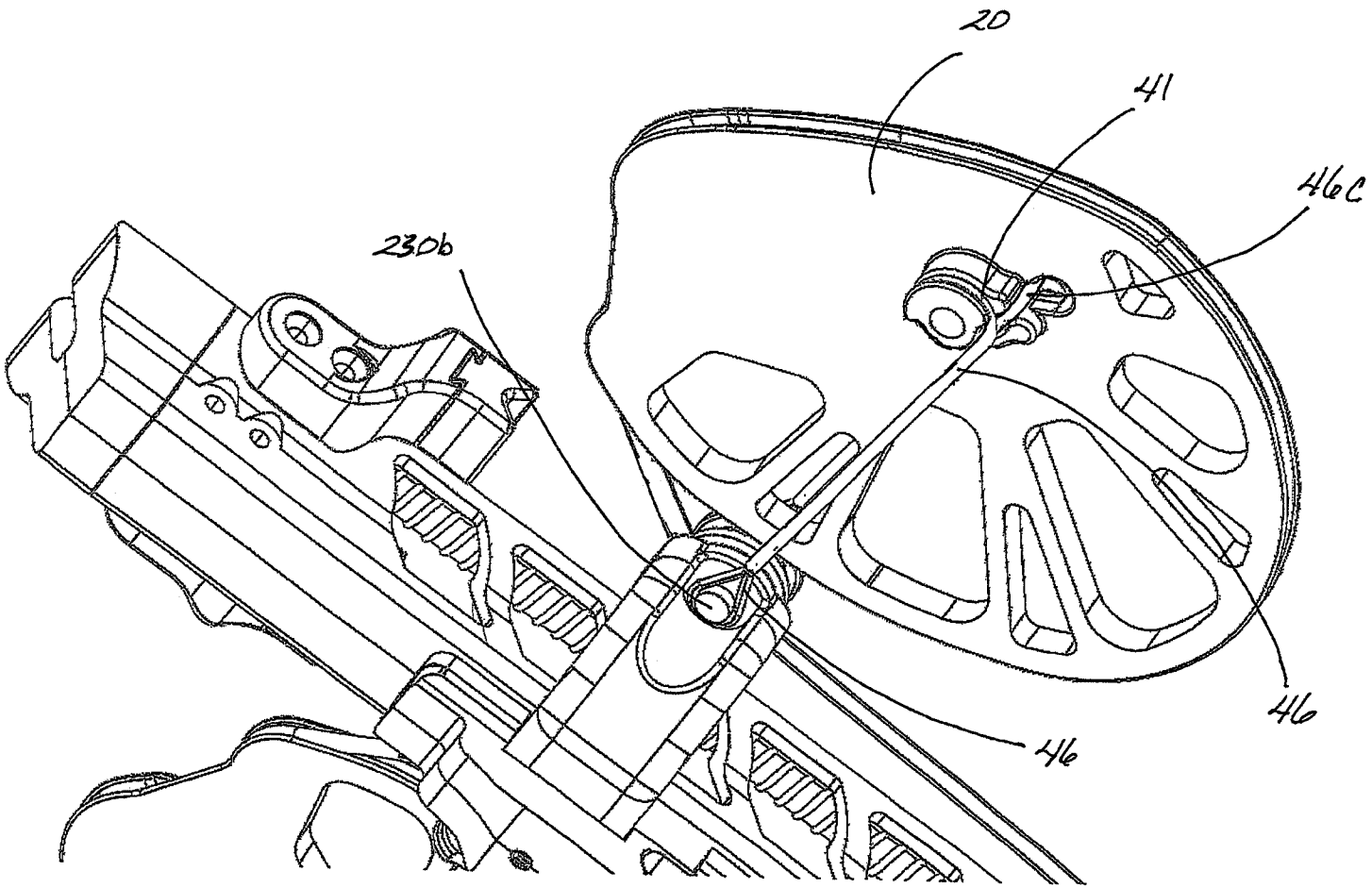
FIG. 8*c* is a partial perspective view of a cocked projectile launching device having forward facing limbs, a single cable per cam, cable ends anchored adjacent the cams, and the mid-segment of the cables passing through a portal of the cams of the present invention.
Figure 8D:
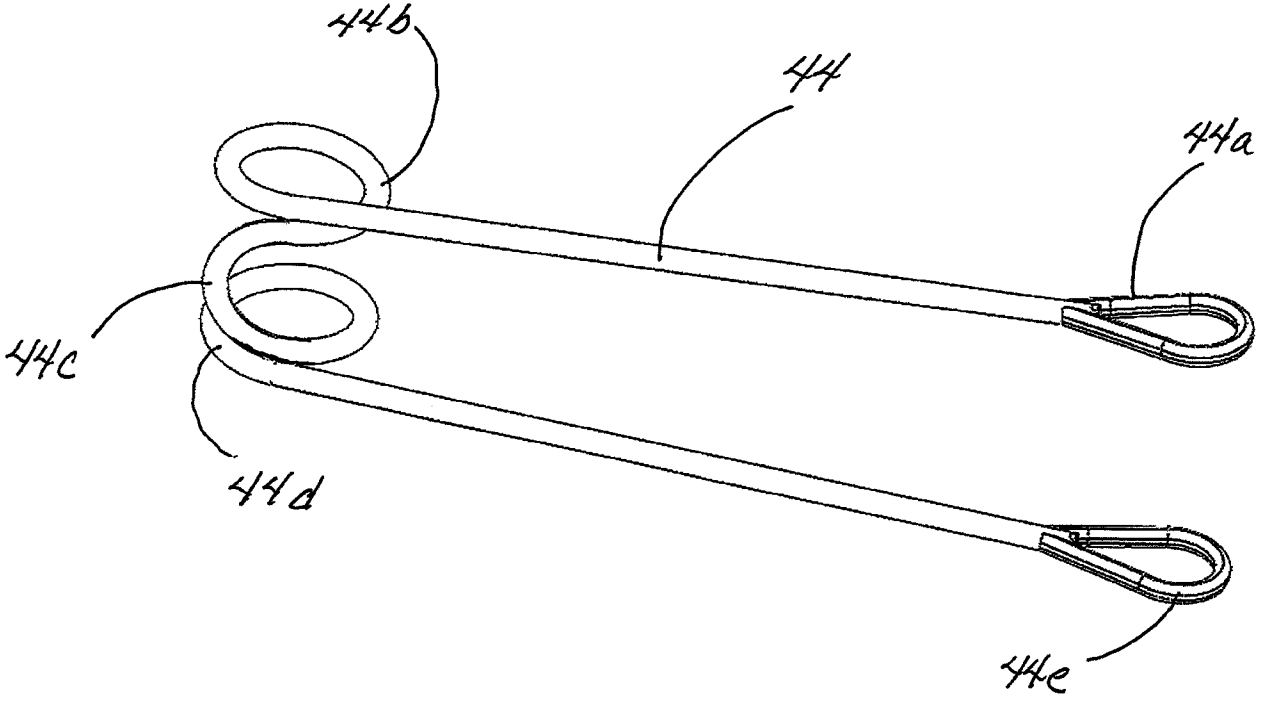
FIG. 8*d* is a perspective view of a projectile launching device, a single cable per cam, showing the cable path only when the device was in the cocked position, of the present invention.

Now referring to FIGS. 8, 8A, 8B, and 8C, disclosed is a reverse draw style crossbow having forward facing limbs (FFL) 14 and 16 wherein the bowstring 22 is drawn from the cams 18 and 20, forward the cam axles 31 and 32. First and second pulleys 217 and 218 support the bowstring 22 when the projectile launching device is drawn, which is best illustrated in FIG. 8B. The location of the pulleys 217 and 218 may or may not be axial with the cable posts 220*a*, 220*b*, 230*a* and 230*b*; the pulleys 217 and 218 may be forward or rearward the location of the cable posts 220*a*, 220*b*, 230*a*, and 230*b*.

Figure 9:
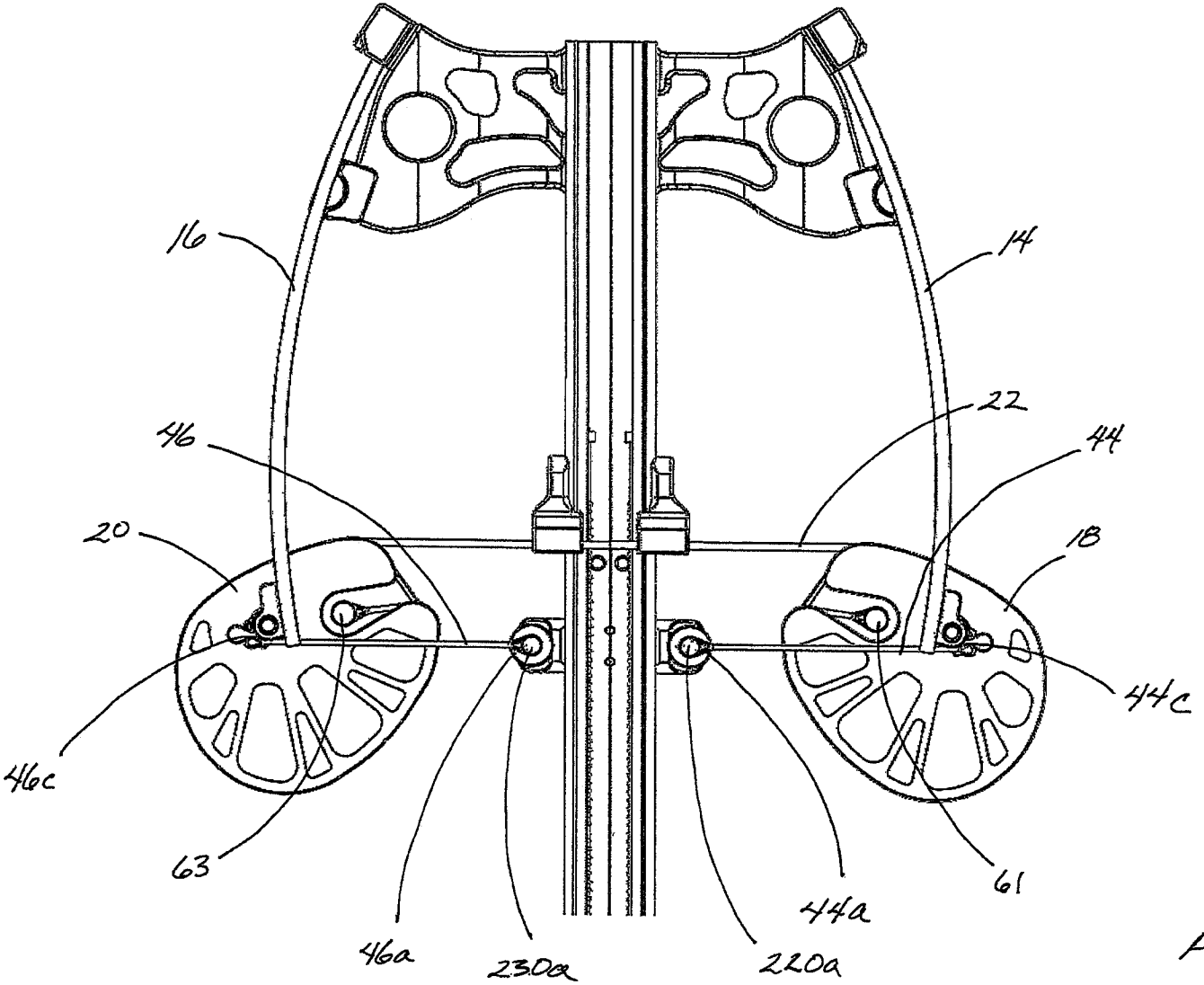
FIG. 9 is a partial top view of an uncocked projectile launching device having rear facing limbs, a single cable per cam, cable ends anchored adjacent the cams, and the mid-segment of the cables passing through a portal of the cams of the present invention.

Referring to FIG. 9, shown is an RFL type crossbow where the bowstring 22 has the main span, the portion of the bowstring 22 that spans between the first cam 18 and the second cam 20, forward cam journaling means. The bowstring pulleys 217 and 218 are supported between the upper cable anchors 220*a* and 230*a* and lower cable anchors 220*b* and 230*b*. The bowstring 22 begins the draw cycle not in contact with the bowstring support pulleys 217 and 218. The bowstring 22 contacts the bowstring supports pulleys 217 and 218 within a few inches of the at-rest position of the bowstring 22, and stays in contact with the support pulleys 217 and 218 the remainder of the draw cycle, and when the crossbow is cocked.

Figure 9A:
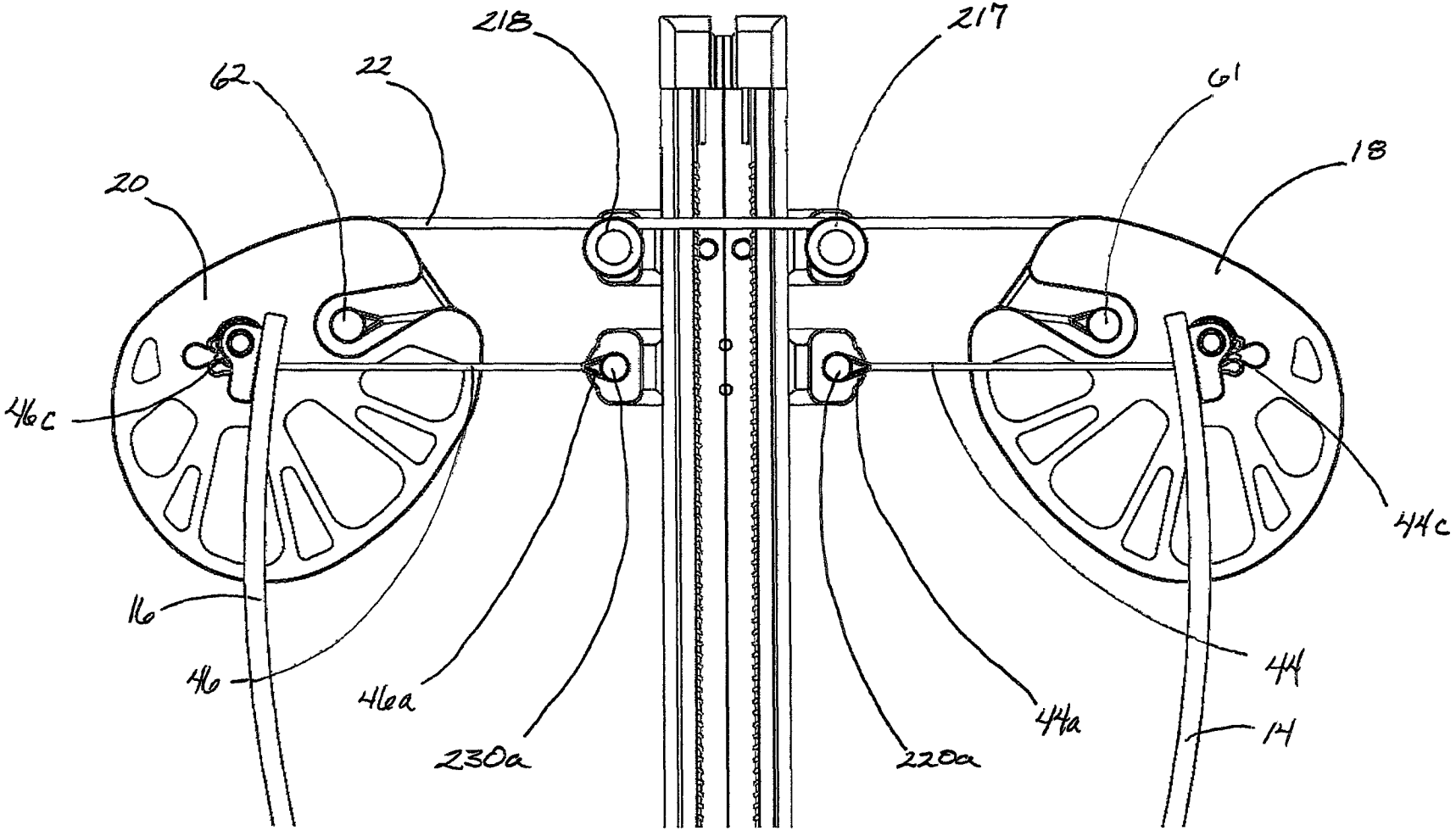
FIG. 9*a* is a partial top view of an uncocked projectile launching device having forward facing limbs, a single cable per cam, cable ends anchored adjacent the cams, the mid-segment of the cables passing through a portal of the cams, and pulleys supporting the bowstring forward the cables of the present invention.

Referring to FIG. 9A, shown is an FFL type crossbow where the bowstring 22 main span is forward the cam journaling means, the bowstring support pulleys 217 and 218 are engaged with the bowstring 22 when the bowstring 22 is at rest. The bowstring 22 stays in contact with the bowstring support pulleys 217 and 218 the entire draw cycle, and when the crossbow is cocked.

A cable arrangement of the current disclosure allows for self-timing, no cam lean, minimal parasitic loss of energy, and minimal shock and vibration due to the low angle of cable movement from when the crossbow is cocked to when the crossbow is fired.

While the preferred embodiments of the invention have been illustrated and described, it will be obvious to those skilled in the art that changes and modifications may be made without departing from the invention in its broader aspects, and therefore, the aim in the appended claims is to cover all such changes and modifications as fall within the true spirit and scope of the invention. These modifications may change the location of the pulleys that support the bowstring. An example of such modification: FFL where the bowstring at rest, without the support pulleys, would place the bowstring span behind the cam axles, yet with the pulleys place the bowstring span forward of the cam axles.

Figure 10:
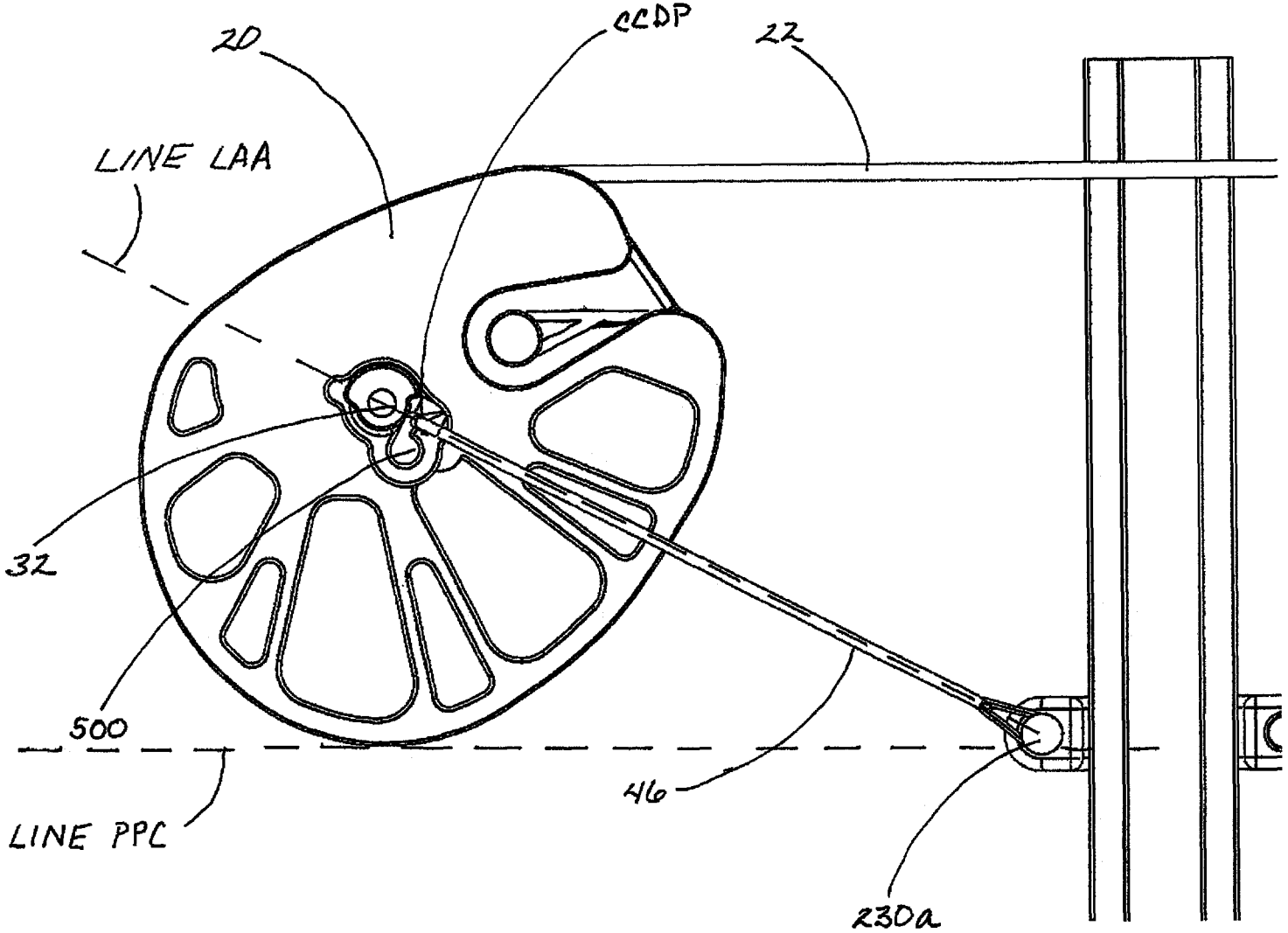
FIG. 10 is a partial top view of a projectile launching device cam, cable, and string configuration wherein the cams utilize a portal for the cam-cable departure points of the present invention.
Figure 11:
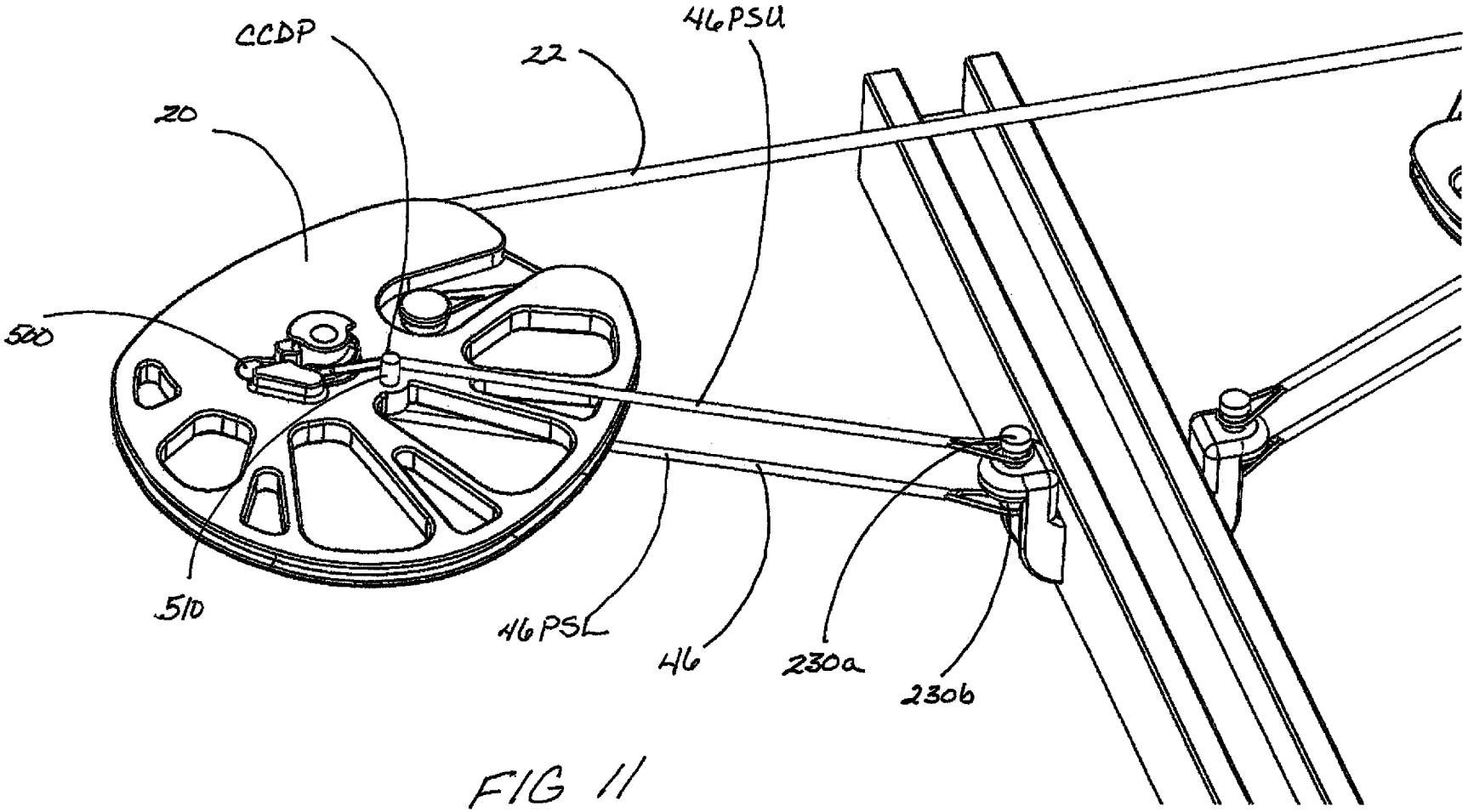
FIG. 11 is a partial perspective view of a projectile launching device cam, cable, and string configuration wherein the cams utilize a portal and a boss for the cam-cable departure points of the present invention.
Figure 12A:
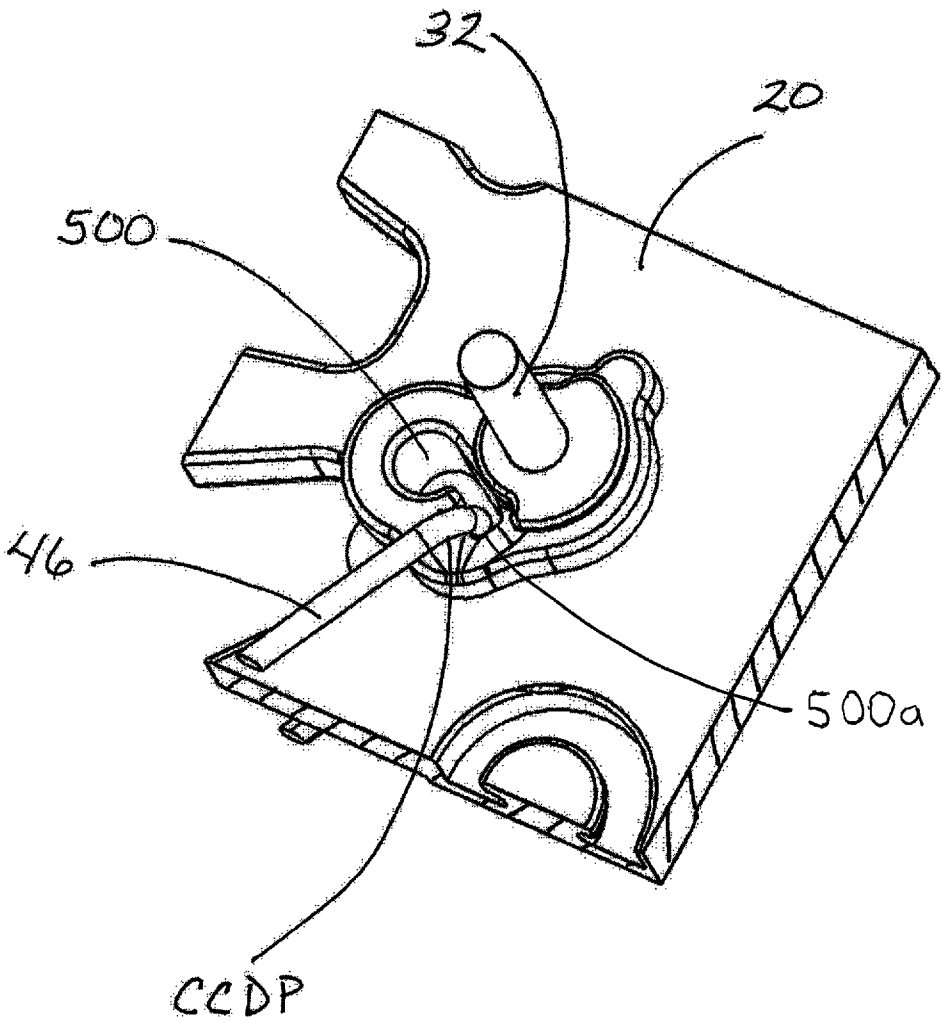
FIG. 12*a* is an enlarged perspective view of a hub area of FIG. 10 of a projectile launching device of the present invention.
Figure 12B:
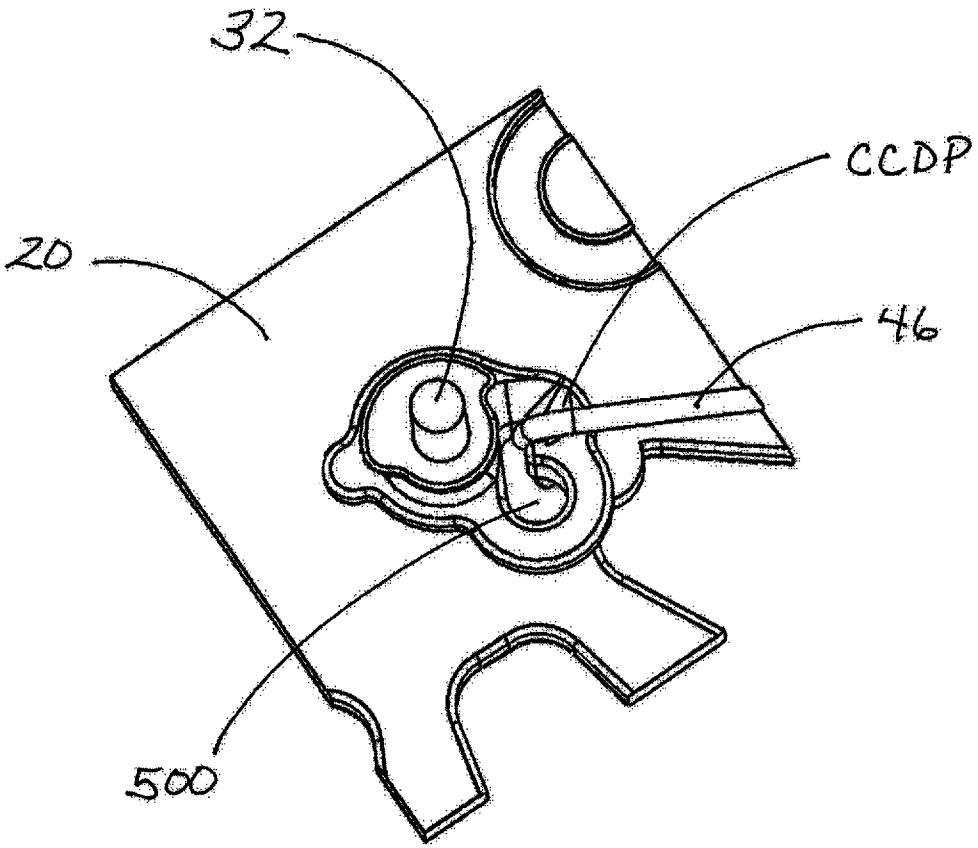
FIG. 12*b* is an enlarged perspective view of a hub area rotated 180 degrees from that of FIG. 12*a* of a projectile launching device of the present invention.

With reference to FIGS. 10 and 11, the subsequent additional invention teaches improved self-timing and the prevention of the unwanted over-rotation and oscillation by way of strategically placed "stops" also known as a boss 510, on the cams 20 (and 18 not shown), or possibly the limbs or energy storing devices. The stops 510 create a cam-cable departure point (CCDP) at the location where the cable 46 loses contact with the stop 510 when the projectile launching device (PLD) is at rest. FIGS. 12*a*-12*b* provide two enlarged views of a cable pocket 500*a*.

For the sake of clarity, we will provide the following non-limiting example. A PLD has two cams 18 and 20, one string 22, and two cables 44 and 46. The bow string 22 is anchored to the first cam 18 and to the second cam 20. The first cable 44 does not cross the center line of the PLD, and the second cable 46 does not cross the center line of the PLD.

We will draw an imaginary line (LAA) between the axis of the cam supporting axles 31 and 32 and the center of the cables 44 and 46 at the non-cam cable retainment feature, which in FIGS. 10 and 11 are the cable anchors 230*a* and 230*b*. A non-cam cable retainment feature is a feature on the PLD that retains either the ends of the cable or the mid-segment of the cable, depending upon the specific configuration of the harness.

When at rest, we will call a line (LCPS) on the radial position of the power segment of the cables at zero degrees, and we will call a line (LACD) from the radial position of the cam-cable departure point to the axis of the cam supporting axle zero degrees. As the bowstring 22 is drawn, the cams 18 and 20 rotate in a first but opposite-to-each-other direction, unwinding the bowstring 22 from the bowstring track of the cams 18 and 20, simultaneously the cams wind cable onto the upper and lower cable tracks 40 and 41 of the cams 18 and 20.

In this example, the cams 18 and 20 rotate 315 degrees. When the PLD is shot, the cams 18 and 20 rotate the opposite direction and back to the at-rest position. The cams 18 and 20 wind the bowstring 22 onto the string track of the cams, and the cams 18 and 20 unwind the cable from the upper and lower cable tracks 40 and 41 of the cams, see FIGS. 8B, 8C. The power segment 44PSU/44PSL and 46PSU/46PSL of the cables 44 and 46 will return to zero degrees.

One embodiment discloses a stop 510 adjacent the cable cam cable tracks 40 and 41 creating a cam-cable departure point CCDP, which prevents the cams 18 and 20 from being able to be manually rotated the opposite direction of drawing the bow when the bow is at rest. The cables 44 and 46 interact with the stop(s). The boss 510 is located adjacent line LAA. The CCDP is located as to force the alignment of the cable power segments 44PSU/44PSL and 46PSU/46PSL with line LAA.

Further explanation of this is that when a cam rotates on the axis of the cam supporting axle, an arc is created by the movement of the cam-cable departure point. The shortest distance between the axis of the cam supporting axle and the cable anchor point is where the arc and the line intersect, and this is also the only position of the elements of the cams, strings, and cables that allow for no unwanted counter rotation of the cams.

In the preferred embodiment, this boss 510 does not project from the surface of the cams 18 and 20 in such a manner as to touch the limbs or energy storing devices in any way. The height of the boss 510 may be sufficient as to stop the unwanted cam rotation, but not so tall as to adversely affect the function of the cams.

In this embodiment, the cables 44 and 46 will be in contact with at least a portion of the surface of the stop 510 when the PLD is at rest, this is called the CCDP. As the PLD is drawn, the cables 44 and 46 may disengage from the stops 510 as the cables 44 and 46 wraps the cable tracks 40 and 41.

An alternate embodiment may have a boss 510 that projects from the surface of the cam 18 and 20 to interact with the limbs or energy storing devices in such a manner as to act as a stop, and stop the rotation of the cams at a desired position when the PLD is at rest.

In another embodiment, the cams 18 and 20 may be designed to function without a boss to restrict the counter rotation of the cams 18 and 20. This may be accomplished by integrating the CCDP with the cable tracks 40 and 41.

Another preferred embodiment requires no stop or boss. The location of the portal 500 and the cam-cable departure point (CCDP) of the portal 500 is such that no counter-rotation of the cams 18 and 20 is allowed. The shortest distance between two points is a straight line. To that end, the placement of the CCDP of the portal 500 is between the axis of the cam supporting axles 31 and 32 (FIG. 6A) and the cable anchor points or retainment points of the pulleys, also known as the non-cam cable retainment feature. This specific placement of the CCDP of the portal 500 sets the cams 18 and 20 in a specific radially position when the PLD is at rest, in that any rotation of the cams, either direction, will always bring the cams 18 and 20 back to this same specific radial position.

Though the straight alignment of the axis of the cam supporting axles 31 and 32, the CCDP and the cable anchors or retainment position of the pulley is the preferred embodiment, the position of the CCDP of the cam 18 and 20 may be adjacent line LAA.

This placement of the CCDP allows for the shortest length cables possible on a PLD. This placement also allows for very little movement of the limbs or energy storing devices should the bowstring 22 break. The length of the bowstring 22 is only required to be sufficient as to place tension on the harness when the PLD is at rest. The static position of the limbs 14 and 16 and cams 18 and 20 when the cables 44 and 46 are coupled to the cams 18 and 20 and the non-cam cable retainment features is only fractionally greater than their position when the bowstring 22 is coupled to the cams. In fact, this static position of the limbs and cams could theoretically be the same whether the bowstring 22 is coupled to the cams 18 and 20 or not.

In one embodiment, the string 22 could be of sufficient length as to functionally to couple the cams 18 and 20 without altering the static position of the limbs 14 and 16, cams 18 and 20, and cables 44 and 46. In another embodiment, the string 22 would be of a shorter length than the sufficient length to functionally couple to the cams 18 and 20 without altering the static position of the limbs 14 and 16; cams 18 and 20; and cables 44 and 46.

Placement of the cable anchors or pulleys, also known as non-cam cable retainment features, may be located at any functional position of the PLD, though the preferred placement would be located between the static position of the bowstring 22 when the PLD is at rest and a line PPC drawn between the most proximal portion of the cams.

Though preferred embodiments have been described, there are many derivatives and modifications that may be made to achieve a functional equivalent to the invention. One functional equivalent might be cables crossing the center line of the PLD as a design feature, a distinction without a difference. Other equivalents of the CDP feature would be the use of a two-track cam, a single cable controlling both cams, or any other design that would utilize the advantages of the proximity of the CDP as disclosed.

We claim:

1. A projectile launching device comprising:

a first 3-track cam and a second 3-track cam, a first cam supporting axle and a second cam supporting axle, a launch string, a first cable coupled with a first non-cam cable retainment feature and a second cable coupled with a second non-cam cable retainment feature, a first line LAA and a second line LAA, said first line LAA passes through said first non-cam cable retainment feature, said first cam supporting axle and a length of said first cable when said projectile launching device is at rest, said second line LAA passes through said second non-cam cable retainment feature, said second cam supporting axle and a length of said second cable when said projectile launching device is at rest, each one of said first and second 3-track cams include a string track, a first cable track and a second cable track, said cable tracks having a perimeter surface that are not concentric with an axis of said cam supporting axles and said cable tracks having an adjacent cam-cable departure point, when said cams are rotated on said cam supporting axles, an arc is created relative to said cam-cable departure point, said cam-cable departure point is between said axles and said non-cam cable retainment feature.

2. The projectile launching device of claim 1:

wherein ends of said cables are not retained on said cams.

3. The projectile launching device of claim 1:

wherein ends of said cables are retained on said cams.

4. A projectile launching device comprising:

a first 3-track cam and a second 3-track cam, a first cam supporting axle and a second cam supporting axle, a launch string, a first cable coupled with a first non-cam cable retainment feature and a second cable coupled with a second non-cam cable retainment feature, a first line LAA and a second line LAA, said first line LAA passes through said first non-cam cable retainment feature, said first cam supporting axle and a length of said first cable when said projectile launching device is at rest, said second line LAA passes through said second non-cam cable retainment feature, said second cam supporting axle and a length of said second cable when said projectile launching device is at rest, each one of said first and second 3-track cams include a string track, a first cable track and a second cable track, said cable tracks having a perimeter surface that are concentric with an axis of said cam supporting axles and said cable tracks having an adjacent cam-cable departure point, when said cams are rotated on said cam supporting axles, an arc is created relative to said cam-cable departure point, said cam-cable departure point is located between said axles and said non-cam cable retainment feature, wherein when the projectile launching device is at rest, the cam cable departure point is closest on said arc and said line LAA to said non-cam cable retainment feature.

5. The projectile launching device of claim 4:
wherein ends of said cables are not retained on said cams.

6. The projectile launching device of claim 4:
wherein ends of said cables are retained on said cams.

7. A projectile launching device comprising:
a first 3-track cam and a second 3-track cam, a first cam supporting axle and a second cam supporting axle, a launch string, a first cable coupled with a first non-cam cable retainment feature and a second cable coupled with a second non-cam cable retainment feature, a first line LAA and a second line LAA, said first line LAA passes through said first non-cam cable retainment feature, said first cam supporting axle and a length of said first cable when said projectile launching device is at rest, said second line LAA passes through said second non-cam cable retainment feature, said second cam supporting axle and a length of said second cable when said projectile launching device is at rest, each one of said first and second 3-track cams include a string track, a first cable track and a second cable track, said cable tracks having a perimeter surface that are not concentric with an axis of said cam supporting axles and said cable tracks having an adjacent cam-cable departure point, when said cams are rotated on said cam supporting axles, an arc is created relative to said cam-cable departure point, said cam-cable departure point is between said axles and said non-cam cable retainment feature, said cam-cable departure point is adjacent said line LAA when the projectile launching device is at rest.

8. The projectile launching device of claim 7:
wherein ends of said cables are not retained on said cams.

9. The projectile launching device of claim 7:
wherein ends of said cables are retained said cams.

10. A projectile launching device comprising:
a first 3-track cam and a second 3-track cam, a first cam supporting axle and a second cam supporting axle, a launch string, a first cable coupled with a first non-cam cable retainment feature and a second cable coupled with a second non-cam cable retainment feature, a first line LAA and a second line LAA, said first line LAA passes through said first non-cam cable retainment feature, said first cam supporting axle and a length of said first cable when said projectile launching device is at rest, said second line LAA passes through said second non-cam cable retainment feature, said second cam supporting axle and a length of said second cable when said projectile launching device is at rest, each one of said first and second 3-track cams include a string track, a first cable track and a second cable track, said cable tracks having a perimeter surface that are concentric with an axis of said cam supporting axles and said cable tracks having an adjacent cam-cable departure point, when said cams are rotated on said cam supporting axles, an arc is created relative to said cam-cable departure point, said cam-cable departure point is between said axles and said non-cam cable retainment feature, said cam-cable departure point is adjacent said line LAA when the projectile launching device is at rest.

11. The projectile launching device of claim 10:
wherein ends of said cables are not retained on said cams.

12. The projectile launching device of claim 10:
wherein ends of said cables are retained on said cams.

13. A projectile launching device comprising:
a first 3-track cam and a second 3-track cam, a first cam supporting axle and a second cam supporting axle, a launch string coupled to said cams, a launch string span between said first and second cams, a first cable passing through a thickness of said first cam and having opposing ends coupled with a first non-cam cable retainment feature, and a second cable passing through a thickness of said second cam and having opposing ends coupled with a second non-cam cable retainment feature a line PPC is perpendicular to a longitudinal axis of a barrel of said projectile launching device, said line PPC is drawn between a rear of said first and second cams and said first and second non-cam cable retainment features, when said projectile launching device is at rest.

14. The projectile launching device of claim 13:
wherein ends of said cables are not retained on said cams.

15. The projectile launching device of claim 13:
wherein ends of said cables are retained on said cams.

* * * * *